US012560405B2

(12) United States Patent
Wallgren et al.

(10) Patent No.: US 12,560,405 B2
(45) Date of Patent: Feb. 24, 2026

(54) MULTI-DIRECTIONAL ADJUSTABLE HOLSTER HANGER

(71) Applicant: Henning's Shop, LLC, Longmont, CO (US)

(72) Inventors: Henning Wallgren, Longmont, CO (US); Jacob Ryan Brodlun, Loveland, CO (US)

(73) Assignee: Henning's Shop, LLC, Longmont, CO (US)

( * ) Notice: Subject to any disclaimer, the term of this patent is extended or adjusted under 35 U.S.C. 154(b) by 154 days.

(21) Appl. No.: 18/139,022

(22) Filed: Apr. 25, 2023

(65) Prior Publication Data

US 2024/0361100 A1 Oct. 31, 2024

(51) Int. Cl.
*F41C 33/04* (2006.01)

(52) U.S. Cl.
CPC ..... *F41C 33/045* (2013.01); *F41C 33/043* (2013.01)

(58) Field of Classification Search
CPC ..... F41C 33/043; F41C 33/045
USPC ..... 224/198
See application file for complete search history.

(56) References Cited

U.S. PATENT DOCUMENTS 5,265,781 A * 11/1993 Nichols ..... F41C 33/0227 224/198
5,372,288 A * 12/1994 Rogers ..... F41C 33/045 224/267
5,467,909 A * 11/1995 Resca ..... F41C 33/0245 224/198
7,690,541 B2 * 4/2010 Pellegrini ..... A45F 5/02 224/198
8,215,525 B2 * 7/2012 Rassias ..... F41G 11/001 224/245
8,783,532 B2 * 7/2014 Gregory ..... F41C 33/045 224/198
2010/0243690 A1 * 9/2010 Lerch ..... F41C 33/02 224/663
2017/0050575 A1 * 2/2017 Dara ..... B60R 7/14

FOREIGN PATENT DOCUMENTS

WO WO-2005086707 A2 * 9/2005 ..... F41C 33/0227

* cited by examiner

*Primary Examiner* — Scott T McNurlen
(74) *Attorney, Agent, or Firm* — Berg Hill Greenleaf Ruscitti LLP

(57) ABSTRACT

The present invention is directed to various embodiments of a multi-directional adjustable holster hanger device configured to be coupled with a holster that can be independently adjusted in a plurality of separate spatial orientations relative to the body of a user to provide a personalized holster configuration to accommodate a rapid and consistent draw of a holstered firearm.

15 Claims, 23 Drawing Sheets

MULTI-DIRECTIONAL ADJUSTABLE HOLSTER HANGER

TECHNICAL FIELD

The present disclosure relates generally to firearm accessories such as holster hangers, and specifically adjustable hangers devices for use with handgun holsters.

BACKGROUND

A wide variety of holsters for handguns have been created, including those for personal, recreational, or competitive use. In the latter example, the need to quickly and reliable draw the firearm from the holster can be especially important. While traditional handgun holsters are attached to a belt, or other article of clothing, such as through a clip, there exists little ability to adjust the holster in such a way that it is maintained in an optimal position relative to the users action of drawing the firearm. In competitive shooting situations, speed and accuracy are paramount. As such, to maintain a holster in a relatively locked position, it can be secured to a holster hanger. Traditional holster hangers, or brackets can similarly be attached to a belt or article of clothing and adjusted so as to position the holster away from the user's body and at an optimal orientation for quickly drawing the firearm. Traditional holster hangers are generally limited in the number of adjustable orientations that can be accomplished. Moreover, most traditional holster hangers include interdependent adjustment element, such that a change in one orientation will alter the orientation of another element requiring the unnecessary adjustment of each element for every single movement of the hanger. To overcome these imitations, some holster hangers use, for example ball joints to allow multi-directional adjustment of the holster. However, such ball joints are difficult to lock into place, and are prone to break after extended use. Moreover, ball-jointed holster hangers cannot independently adjust and secure the holster in a preferred orientation. For example, any movement of the ball joint will affect the position and orientation of the holster in multiple different direction.

As such, there exists a long-felt need for an improved holster hanger that overcomes these limitations. Specifically, there exists a need for an improved holster hanger that can be independently adjusted into a plurality of orientations to accommodate a user's preferred anatomy and firearm draw technique.

SUMMARY OF THE INVENTION

In one aspect, the present invention includes a multi-directional adjustable holster hanger device. In one preferred aspect, the adjustable holster hanger device can be coupled with a holster that can be adjusted in a plurality of separate orientations relative to the body of a user, wherein each adjustment in orientation is independent of the others.

In another aspect, the present invention includes a multi-directional adjustable holster hanger device that can be independently adjusted in at least four orientations, such that the adjustment of one orientation is independent such that that it does not disturb the other three orientations. In a preferred embodiment, the multi-directional adjustable holster hanger device can be independently adjusted in at least four orientations, namely: height, caster, toe, and camber orientations as described generally herein.

In another aspect, a multi-directional adjustable holster hanger device of the invention includes a base coupled with an arm through a caster joint allowing movement along a first orientation, namely a caster orientation which includes the rotation of the arm relative to the base. In another preferred aspect, a rail adaptor can further be slidably coupled with the arm through a rail joint allowing the adaptor to independently adjusted along a second orientation, namely a height orientation such that the rail adaptor can be independently positioned along the length of the arm of the invention relative to the base. In another preferred aspect, a camber adaptor can be configured to be mechanically responsive to a holster plate through a camber joint allowing movement along a third orientation, namely the cambered movement of the holster plate relative to said base. In another preferred aspect, a toe adaptor can be configured to form a toe joint mechanically responsive to the holster plate allowing movement along a fourth orientation, namely the adjustment of the toe angle of the holster plate relative to the base.

In another aspect, the present invention includes a rotationally adjustable holster hanger device that can be independently adjusted in at least two orientations, such that the adjustment of one orientation is completely independent and does not disturb the other orientations. In this preferred aspect, a rotationally adjustable holster hanger device of the invention includes a base configured to be secured to a user. A rotational adaptor can be coupled to the base through a caster joint allowing rotation of the adaptor relative to the base, the rotational adjustment being preferably 360° degrees. In this preferred aspect, a holster plate can be further coupled to the rotational adaptor through a camber joint allowing cambered movement of the holster plate relative to the base.

In another aspect, the present invention includes an adjustable holster hanger device that can be independently adjusted in at least three orientations, such that the adjustment of one orientation is completely independent and does not disturb the other two orientations. In this preferred aspect, an adjustable holster hanger device of the invention includes a base coupled with an arm through a caster joint allowing rotation of the arm relative to the base. An adaptor can be slidably coupled with the arm through a rail joint allowing the adaptor to be positioned along the length of the arm at a desired position. In this preferred embodiment, the holster plate can be coupled with the adaptor through a toe joint allowing adjustment of the toe angle of the holster plate relative to the base.

Additional aspects of the invention include methods of manufacturing any of the adjustable holster hangers of the invention generally described herein. Additional aspects of the invention include methods of using any of the adjustable holster hangers of the invention generally described herein.

Additional aspects of the invention will be evident from the specification, figures, and claims provided herein.

DETAILED DESCRIPTION OF INVENTION

Figure 1:
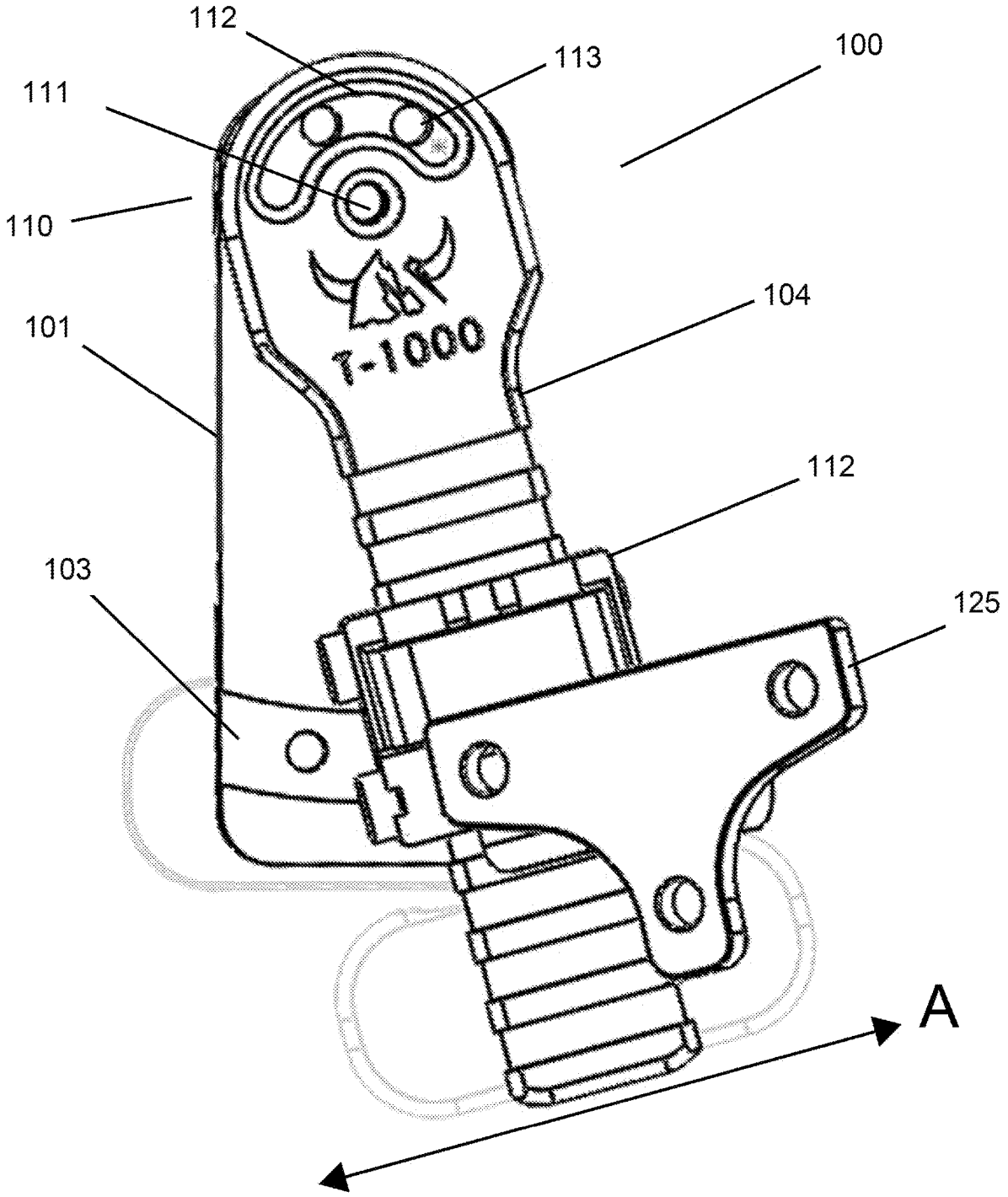
FIG. 1: shows a front view of a multi-directional adjustable holster hanger device with the arm rotated into a forward position and a holster plate positioned with an outward extended toe angle in one embodiment thereof.

The present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

The present invention include a multi-directional adjustable holster hanger (100) device. In one embodiment, the multi-directional adjustable holster hanger (100) device includes a base (101) coupled with an arm (104) through a caster joint (110). Additional embodiments include a rail adaptor (112) coupled with the arm (104) through a rail joint (115). Further embodiments include a camber adaptor (122) coupled with a holster plate (125) through a camber joint. Further embodiments include a toe adaptor (118) responsive to the holster plate (125) through a toe joint (119). Further embodiments include a holster (130) coupled with a holster plate (125).

In the embodiment shown in FIGS. 1-1010, the multi-directional adjustable holster hanger (100) of the invention, sometimes referred to herein as a multi-directional holster hanger (100), or holster hanger (100) of the invention, includes a base (101). In this preferred embodiment, the base (101) of the invention includes an elongated plate component, preferably made of metal, plastic, or other composite material that can be secured to a user, preferably through a coupler device, such as a clip, or other similar coupling device known or used to secure a holster (130) to a user. In this configuration, the base (101) can be secured to a user's clothing on either the right or left hand side according to the dominant or draw hand of the user.

Figure 2:
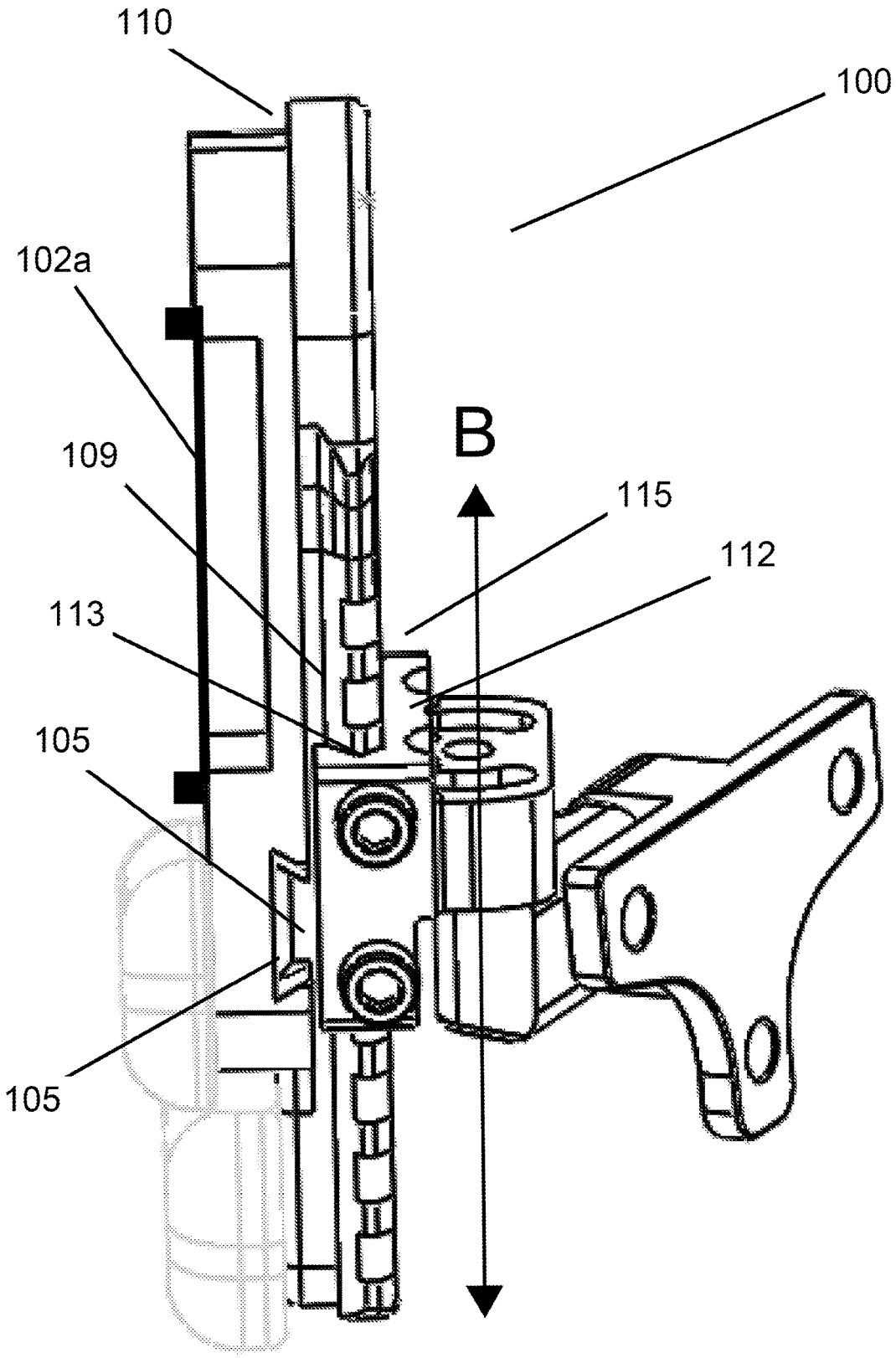
FIG. 2: shows a side view of a multi-directional adjustable holster hanger device with a rail adaptor secured to the arm through a rail joint in one embodiment thereof.

The base (101) of the invention includes a belt channel (102). In the embodiment shown in FIG. 2, a belt channel (102) can include an integral channel positioned horizontally along the rearward surface of the base (101). In this embodiment, a belt or other similar article can be positioned within the belt channel (102) and secured by one or more belt loops (102*a*). Again, as shown in FIG. 2, the belt loop (102*a*) of the invention can include a rigid bar extending across the belt channel (102). In this embodiment, a belt or other similar article can be positioned within the belt channel (102) and secured therein by one or more of the belt loops (102*a*), which can be compressed against the belt or other article by one or more fasteners, such as a threaded coupler. Further, in this embodiment a user can release the belt or other article by loosening the fasteners, thereby removing the compression against the belt. In this manner a user can secure the base (101) of the invention in a position that is optimal, or the most comfortable for a rapid and fluid removal, or "drawing" of the firearm secured within a holster (130) as described below.

As further shown in FIGS. 1-10, a glider pads (136, 135) can be secured to the bottom portion of the base (101) and arm (104) respectively. In a preferred embodiment, the glider pads (136, 135) of the invention can include a plastic, metal or composite pad that can rest against the user and provide a buffer against the user's body, and further provide a sliding surface for articulation of the components.

The multi-directional adjustable holster hanger (100) of the invention can be configured to allow the rotational coupling of an arm (104) with the base (101) of the invention. In the preferred embodiment shown in FIGS. 1-1010, the arm (104) of the invention can include an elongated plate component, preferably made of metal, plastic, or other composite material that can be positioned approximately flush with the base (101), and rotatably coupled with the base (101) through a caster joint (110). As used herein, a caster joint (110) generally refers to a rotatable coupling between the base (101) and the arm (104) that is configured to allow rotation of the arm (104) along an approximately parallel plane relative to the base (101), which is shown in FIG. 1 as the rotational direction (A). In a preferred embodiment, the caster joint (110) of the invention is coupled to the top front surface of the base (101) and can be further configured to rotate along an axis that is perpendicular to the top portion of the base (101) allowing rotation of the arm (104) relative to the base (101) in an approximately parallel plane relative to the base (101). In this embodiment, the perpendicular axis can be positioned at a caster pivot (111). In this embodiment, the caster pivot (111) of the invention can include a position where the arm (104) and base (101) of the invention can be rotatably coupled.

As shown in FIGS. 1-10, generally, the caster pivot (111) of the invention can include an aperture on the arm (104) of the invention. A fastener (not shown), or other coupler such as a pin can be inserted through the aperture and secured to the base (101). In a preferred embodiment, a threaded fastener can be inserted through the aperture and secured to the base (101). In this configuration, the threaded fastener can be loosened to allow rotational adjustment of the arm (104), generally referred to as caster or caster movement (A) of the arm. Alternatively, the threaded fastener can be tightened so as to restrict rotational adjustment of the arm and prevent the castered movement of the arm (104) relative to the base (101).

In alternative embodiments of the invention, the caster joint (110) of the invention can further include a caster channel (112). As shown in FIGS. 1-10, the caster channel (112) of the invention can include an extended aperture on the upper portion of the arm (104). When the base (101) and (arm) are positioned adjacent to one another, one or more caster apertures (113) on said base (101) can be accessible through the caster channel (112). In this configuration, the arm (104) can be secured to the base (101) through a fastener, and can further be locked into a position relative to the base (101) through a fastener inserted into a caster aperture (113) on the base (101) that is accessible through the caster channel (112) of the arm (104). The fastener (not shown) can preferably include a threaded fastener that can secure the arm (104) and base (101) through the caster channel (112). In this configuration, the threaded fastener can be loosened so as to become disengaged from the caster aperture (113) on the base (101) thereby allowing rotational adjustment of the arm (104) along pathway A as described above. Alternatively, the threaded fastener(s) can be tightened so as to become engaged with the caster aperture (113) on the base (101) thereby generating a compression force against the arm (104) and restricting its rotational adjustment relative to the base (101).

As can be appreciated, in certain embodiments the caster joint (110) can be configured to allow full rotational movement, or a full 360° degree rotational movement of the arm (104) relative to the base (101). However, in the preferred embodiment shown in FIGS. 1-10, the rotation of the arm (104) relative to the base (101) can be restricted. Specifically, in this embodiment, the arm (104) of the invention can rotate around the caster pivot (111) along the traverse distance of the caster channel (112). So, as the arm (104) rotates forward, the caster channel (112) of the arm rotates along pathway A until it contacts a fastener, or other similar pin or coupler positioned through the channel (112) and secured to the base (101) that mechanically restricts further rotational movement along pathway A. In this configuration, the length or traverse of the channel can determine the limits of forward or reverse rotational movement, or caster of the arm (104) relative to the base (101). Notably, as shown in the Figures, a caster channel (112) of the invention can be arched to match the rotational travers angle of the arm (104) as it rotates relative to the base (101).

The multi-directional adjustable holster hanger (100) of the invention can be configured to allow the vertical adjustment (B) of a coupled holster (130) along the length of the arm (104). In this embodiment, a rail adaptor (112) can be configured to be coupled with the arm (104) and further be adjustably positioned along the length of the arm (104) according to a user's preferred or desired height along pathway B. It should be noted that the rail adaptor (112) of the invention may or may not include a rail coupling or even a slidable coupling. In certain embodiments, the rail adaptor (112) of the invention can be coupled at different positions along the length of the arm (104). Such adjustable coupling can be accomplished through clips, fasteners, or other coupling devices, such as spring couplers, slide couplers, quick release couplers, twist couplers, and the like.

In the preferred embodiment shown in FIGS. 1-10, the rail adaptor (112) of the invention can include a component formed of metal, plastic, or other composite material that can be slidable coupled with said arm (104) through a rail joint (115). In this configuration, the rail joint (115) of the invention allows the rail adaptor (112) to be adjustably secured along the length of said arm (104). In this manner, the positioning of the rail adaptor (112) along the arm (104) of the inventions allows a responsive holster (130) to be positioned, relative to a user, in the most comfortable or optional height configuration for a rapid and fluid removal, or "drawing" of the firearm secured within the holster (130).

Again referring to FIGS. 1-10, the rail adaptor (112) of the invention can be slidably secured to a rail (109) positioned on the arm (104) of the invention. In this embodiment, rail adaptor (112) may include a rail interface (113) that is configured to slidably engage with the rail (109). In this embodiment, the rail interface (113) and rail (109) form a dovetail joint that allows the rail adaptor (112) to securely slide along the length of the arm (104). In this embodiment, the front surface of the arm (104) of the invention can include a mounting surface (134). In a preferred embodiment, the mounting surface (134) of the invention can be configured to provide one or more mounting positions to allow the rail adaptor (112) to be secured to the arm (104). As shown in the embodiment of FIGS. 1-10, a mounting surface (134) of the invention can include a plurality of steps (107) and grooves (108) placed in series along the arm (104) of the invention forming a picatinny rail surface. As noted above, numerous methods of securing a rail adaptor (112) to a picatinny rail surface are known in the art.

Referring again to FIGS. 1-10, the rail adaptor (112) of the invention can be secured to the arm (104) through one or more fasteners, and preferably a threaded coupler. In this preferred embodiment, a rail fastener (117) can be inserted into a corresponding rail aperture (116) on the rail adaptor (112) of the invention. In this configuration, the rail fastener (117) is inserted into a groove (108) of the mounting surface (134) and secured within the channel of the groove (108) by adjacent steps (107). In a preferred embodiment, the rail fastener (117) includes a threaded coupler that can be secured with a threaded portion of the rail aperture (116).

In another embodiment, the base of the invention can include a slot (103) configured to be slidably coupled with a pin (105) on the arm (104) forming a slide joint (106). As shown in FIG. 1, in a preferred embodiment the slot (103) of the invention includes an arched integral channel on the front surface of the base (101). The pin (105) of the invention includes an extension extending rearward from the arm (104). As shown in FIGS. 1-2, the slot (103) and extension (105) can form a sliding dovetail connection that can further be arched to match the rotation of the arm along pathway B as described herein. In this configuration, the rotational movement of the arm (104) can be laterally stabilized by the sliding engagement of the slot (103) and pin (105).

The multi-directional adjustable holster hanger (100) of the invention can be configured to allow the outward or inward swinging adjustment (C), also referred to as toe movement or toe angle, of a coupled holster (130) in relation to the arm (104). In this embodiment, a toe adaptor (118) can be configured to form a toe joint (119) that is responsive to a holster plate (125) allowing adjustment of the toe angle of the holster plate (125) along pathway C as shown in FIG. 3, relative to the base (101).

Figure 3:
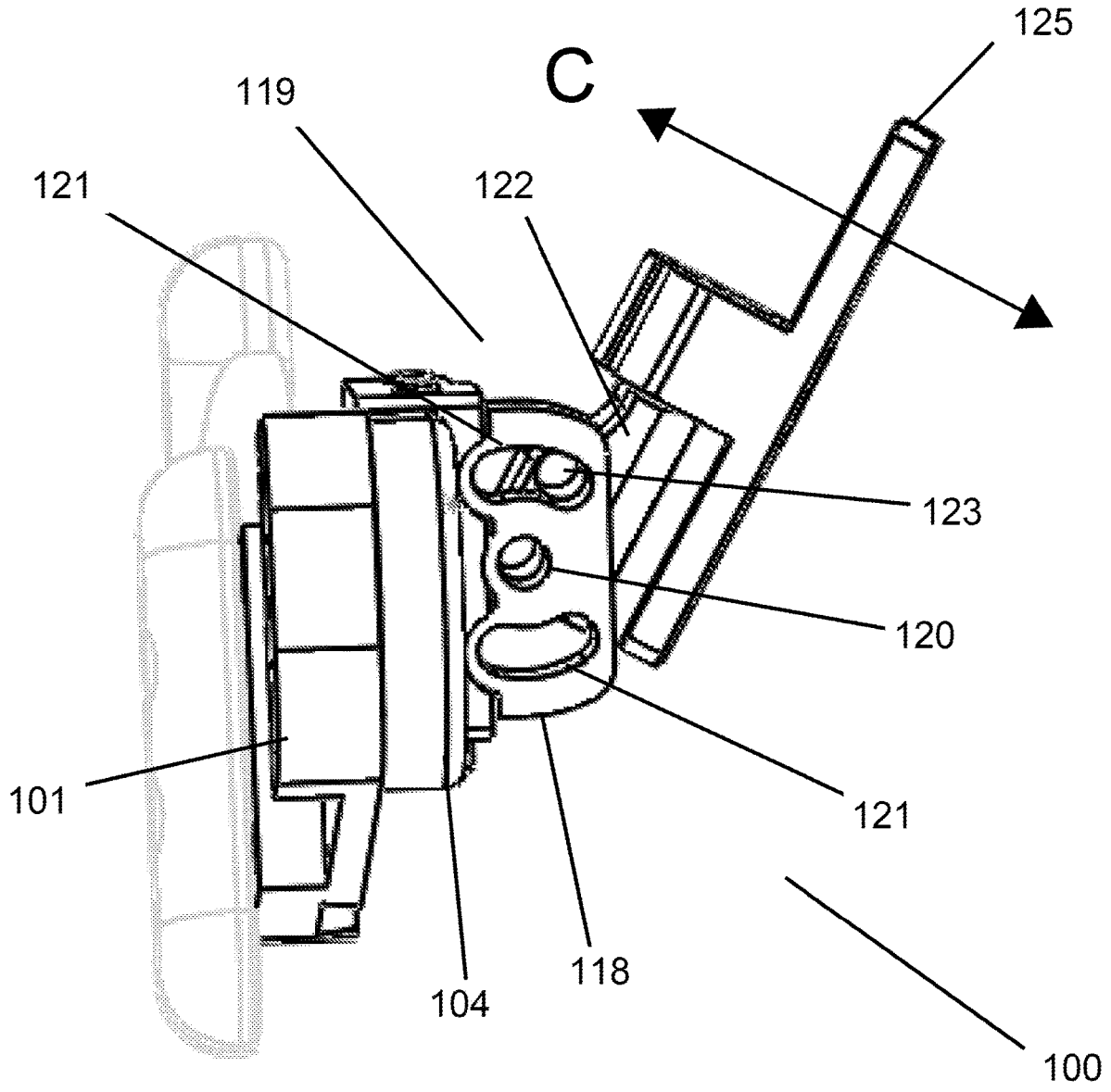
FIG. 3: shows a top view of a multi-directional adjustable holster hanger device with a toe adaptor that is mechanically responsive to a holster plate through a toe joint securing a camber adaptor, with the toe angle of the holster plate extended outward relative to the base in one embodiment thereof.

As shown in FIGS. 1-10, the toe adaptor (118) of the invention can include a component, preferably made of metal, plastic, or other composite material that is configured to be positioned on the front surface of the rail adaptor (112) such that it is responsive to the position of the rail adaptor (112) along pathway B as shown in FIG. 2. The toe adaptor (118) can further be responsive to a holster (3) through a toe joint (119) that is configured to allow adjustment of the toe angle of the responsive holster (130) along pathway C as shown in FIG. 3. In this preferred embodiment, the toe joint (119) of the invention includes a toe pivot (120) coupled with a toe pivot aperture (124) on a camber adaptor (122) as described herein. In this embodiment, the toe joint (119) allows the toe adaptor (118) to rotate around the toe pivot aperture (124), which is preferably positioned approximately central to the body of the toe adaptor (118). The toe adaptor (118) of the invention further can include one, or a pair of opposing toe channels (121) positioned adjacent to the toe pivot (120). In this configuration, the toe adaptor (118) can be secured to an adjacently positioned camber adaptor (122) by a toe fastener (not shown), such as a threaded coupler or pin secured to a toe aperture (123) on the camber adaptor (122). As shown in FIG. 3, the toe aperture (123) of the invention is accessible through the toe channel (121), such that a fastener can be secured therein. In this configuration, the camber adaptor (122) is rotatably coupled with the adjacent toe adaptor (118) allowing rotational adjustment of the toe angle of a responsive holster plate (125) around the toe pivot (120) along pathway C relative to the base (101).

In the preferred embodiment shown in FIG. 3, the rotation of the camber adaptor (122), and by extension the responsive holster plate (125) relative to the base (101), can be restricted. Specifically, in this embodiment the camber adaptor (122) of the invention can rotate around the toe pivot (120) along the traverse distance of the toe channel (121). So, for example as the camber adaptor (122) rotates along pathway C away or towards from the base and user's body, the fastener secured to the camber adaptor (122) and positioned within the toe channel (112) rotates along pathway C until the fastener, or other similar pin or coupler positioned, mechanically restricts further movement along pathway C. In this configuration, the length or traverse of the camber adaptor (122) can determine the limits of the toe angle adjustment of the camber adaptor (122) relative to the base (101).

As noted above, in certain embodiments the toe adaptor (118) can include a pair of toe channels (121) positioned in an opposing orientation in relation to the toe pivot (120). In this manner, the camber adaptor (122) of the invention can be reversibly secured in either a "right-hand" or left-hand" orientation by a fastener secured in one or the other toe channels (121). In this configuration, the toe adaptor (118) allows for the adjustment of the responsive holster (130) in a "right-hand" or left-hand" orientation to accommodate a user's dominant or preferred draw hand.

The multi-directional adjustable holster hanger (100) of the invention can be configured to allow adjustment of a cambered angle along pathway D of a coupled holster (130) relative to a base (101). In this embodiment, a camber adaptor (122) is configured to be responsive to said holster plate (125) through a camber joint (126) allowing the cambered movement of the holster plate (125) along pathway D as shown in FIG. 4, relative to the base (101).

As shown in FIGS. 1-10, the camber adaptor (122) of the invention can include a component, preferably made of metal, plastic, or other composite material that is responsive to a holster (130) through a camber joint (126) configured to adjust the camber angle of a holster plate (125) along pathway D. In the preferred embodiment shown in FIG. 4, the camber adaptor (122) of the invention can be coupled with a holster plate (125) through a camber joint (126) configured to allow the cambered swinging movement of the holster plate (125) along pathway D. In this preferred embodiment, the camber joint (126) of the invention includes a camber pivot (133) secured by, for example, a fastener or similar pin components, positioned within a camber pivot aperture (129) the body of the camber adaptor (122). In this configuration, the holster plate (125) can rotate along the camber pivot (133) thereby allowing the cambered swinging movement of the holster plate (125) along pathway D as shown in the Figures.

Figure 4:
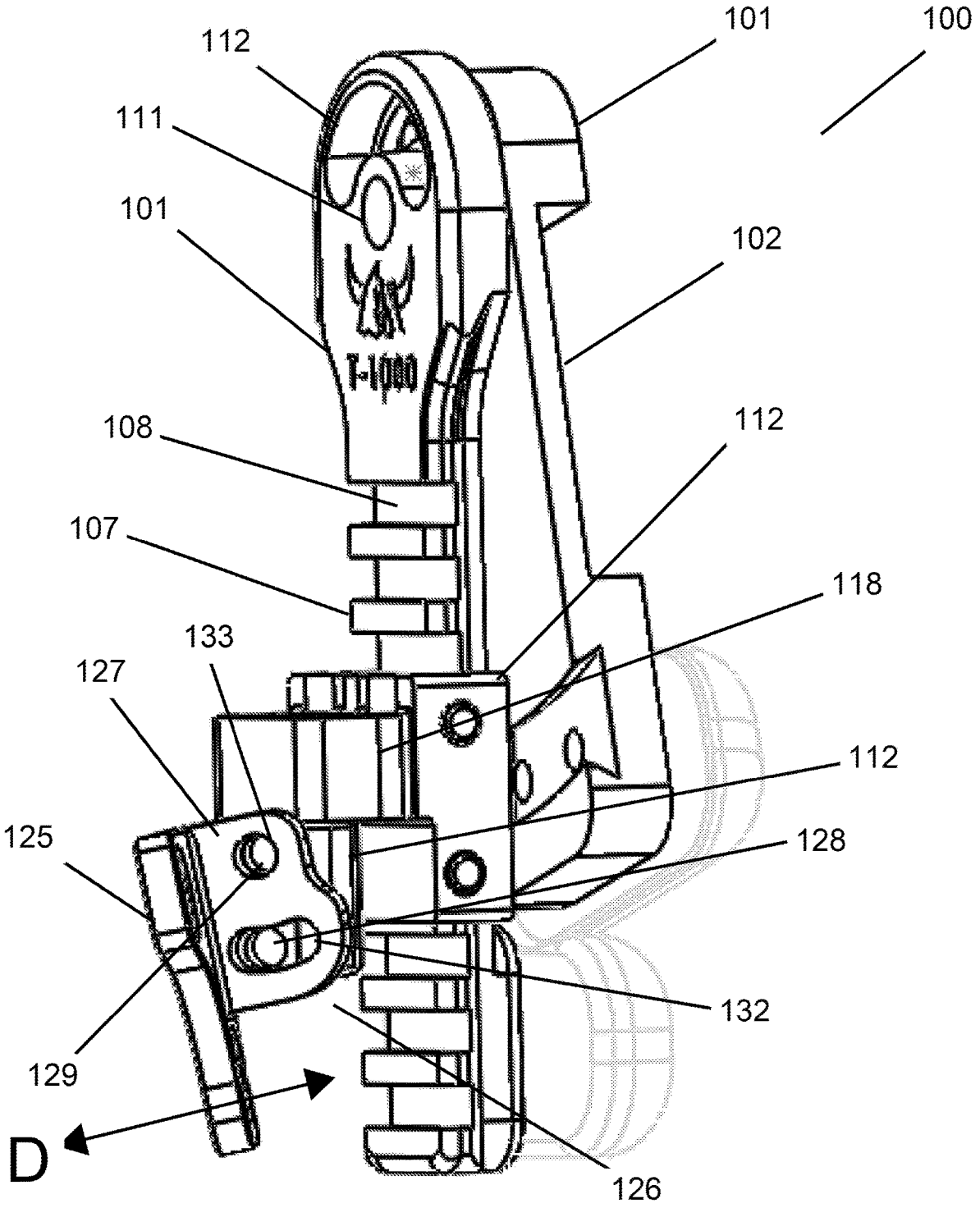
FIG. 4: shows a side perspective view of a multi-directional adjustable holster hanger device with a camber adaptor responsive to said holster plate through a camber joint allowing cambered movement of the holster plate relative to said base, and a rail adapter secured to the top portion of the arm through a rail joint in one embodiment thereof.
Figure 5:
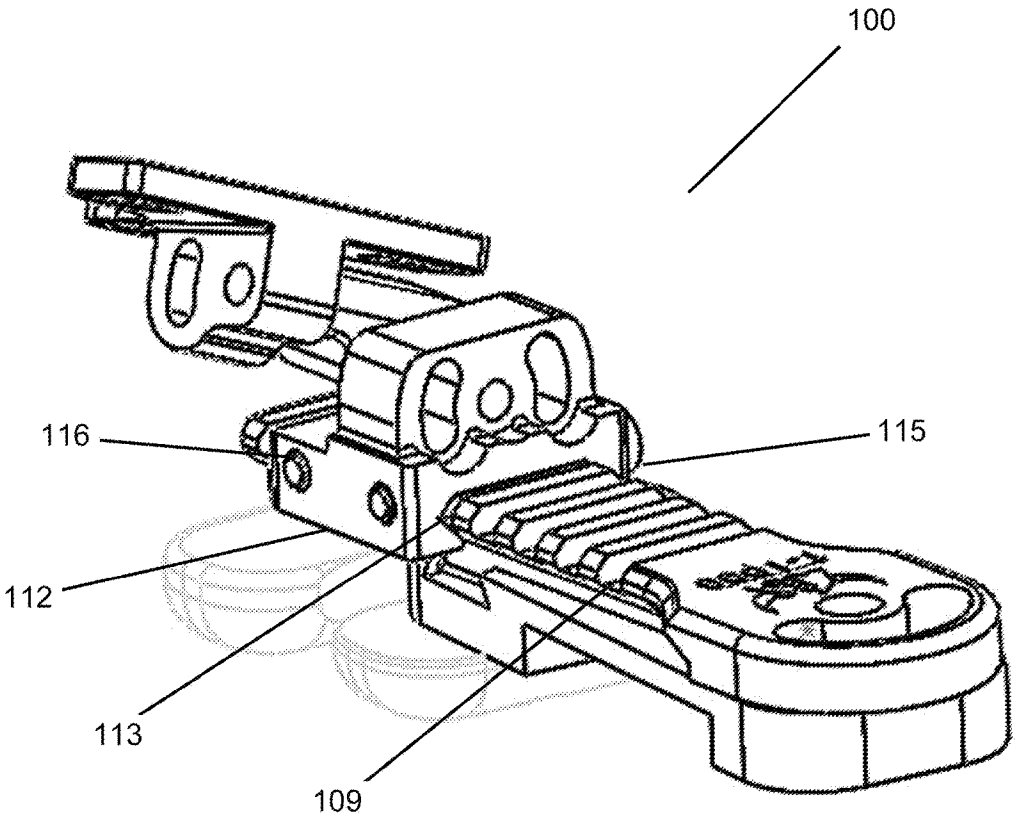
FIG. 5: shows a top perspective view of a multi-directional adjustable holster hanger device with the arm rotated into a forward position and a holster plate positioned with an inward extended toe angle, and a pin on the arm being positioned in a slot on the front surface of the base in one embodiment thereof.
Figure 6:
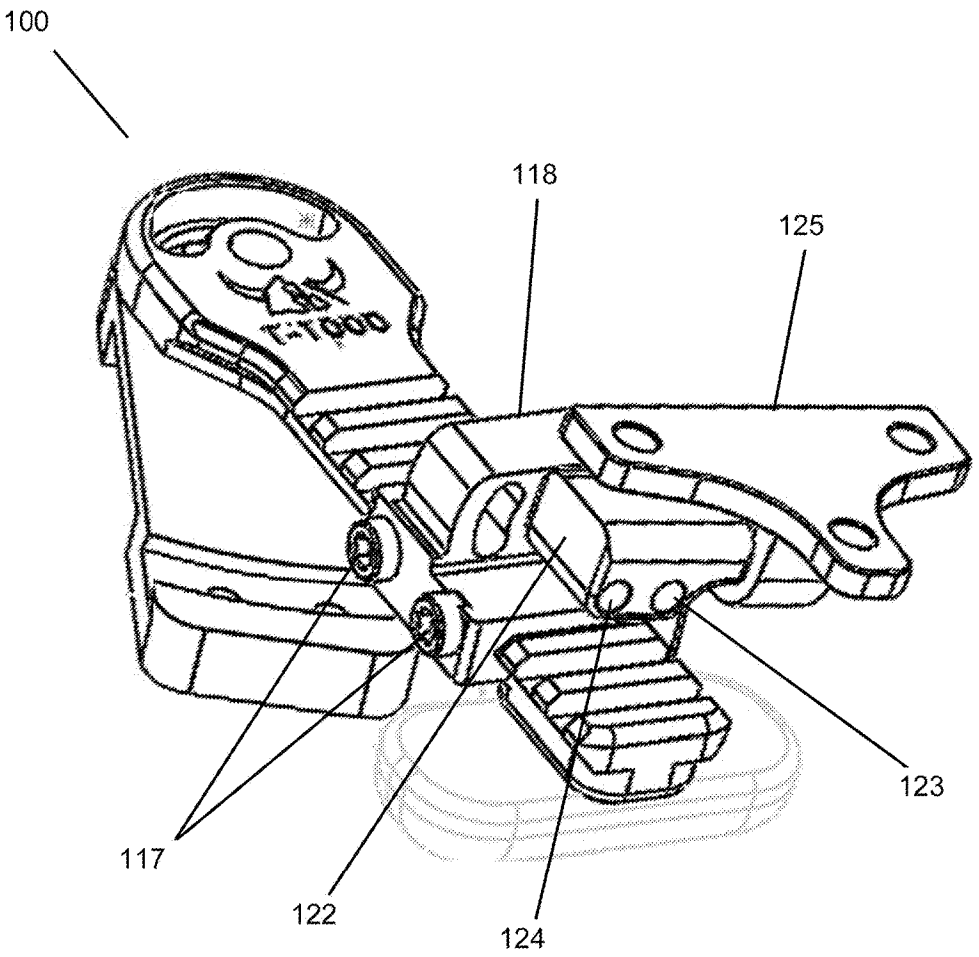
FIG. 6: shows a bottom perspective view of a multi-directional adjustable holster hanger device with a toe adaptor that is mechanically responsive to a holster plate through a toe joint securing a camber adaptor, with the toe angle of the holster plate extended outward relative to the base and a rail adapter secured to the bottom portion of the arm through a rail joint in one embodiment thereof.
Figure 7:
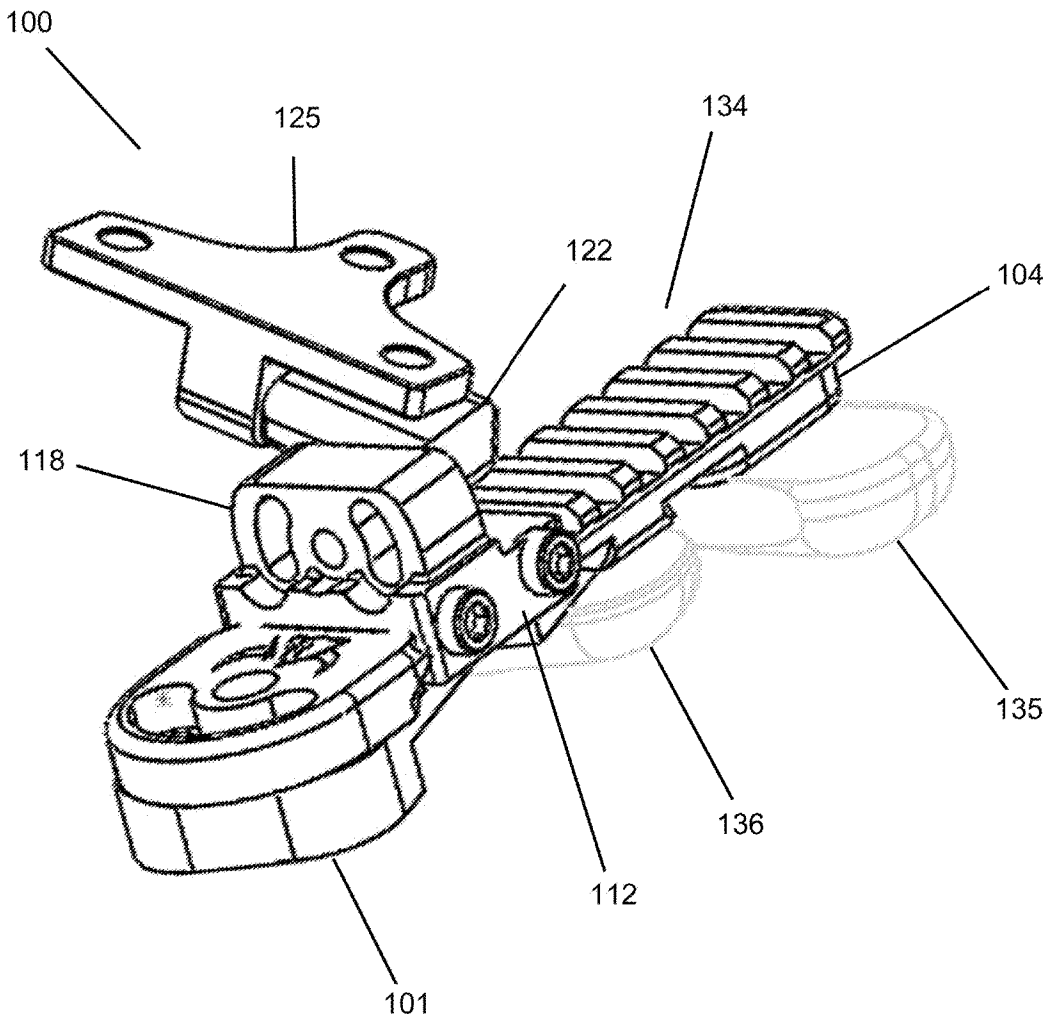
FIG. 7: shows a top perspective view of a multi-directional adjustable holster hanger device with the arm rotated into a forward position and a holster plate positioned with an inward extended toe angle in one embodiment thereof.
Figure 8:
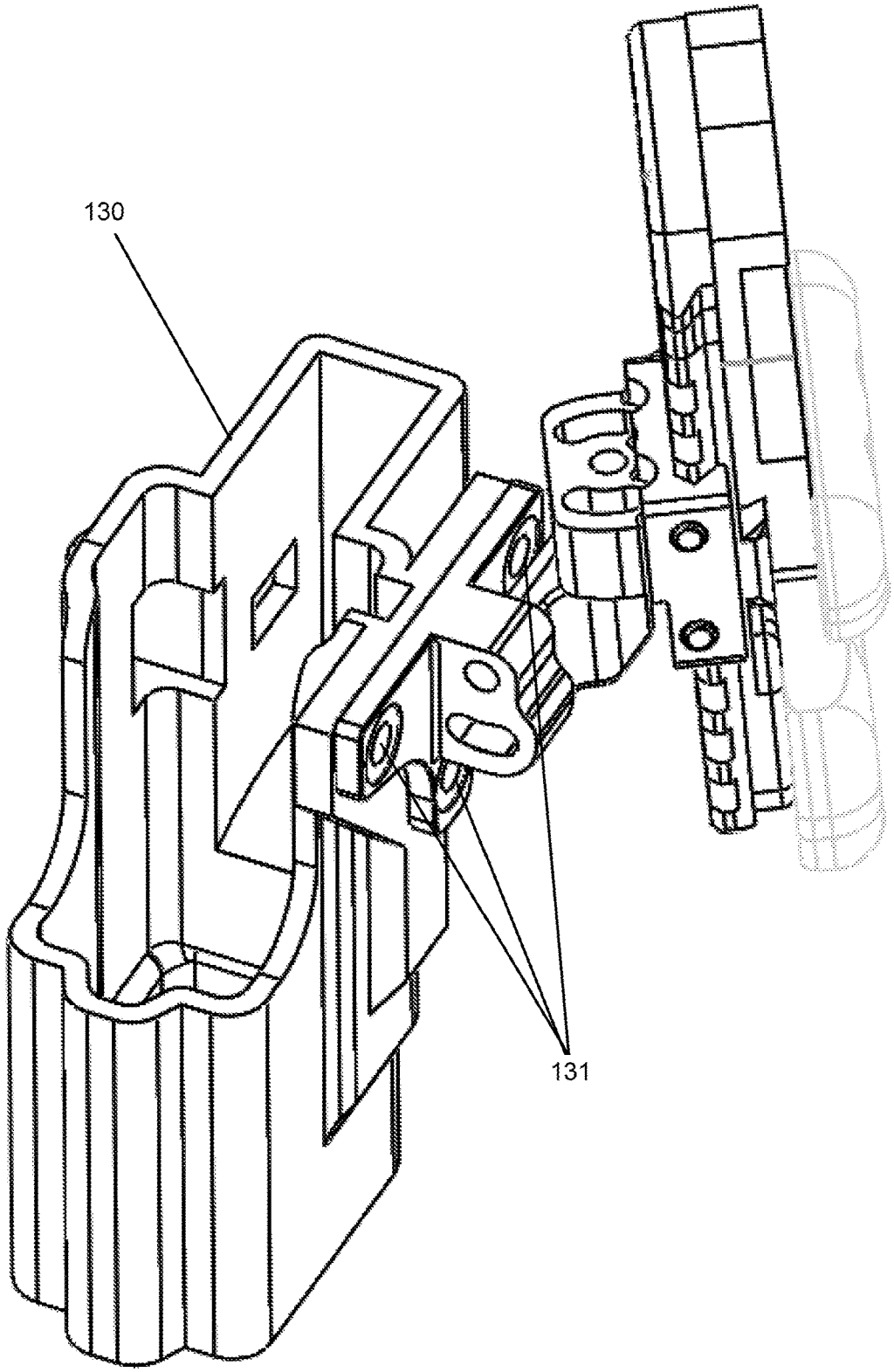
FIG. 8: shows a perspective view of a multi-directional adjustable holster hanger device coupled with an exemplary holster through a holster plate.
Figure 9:
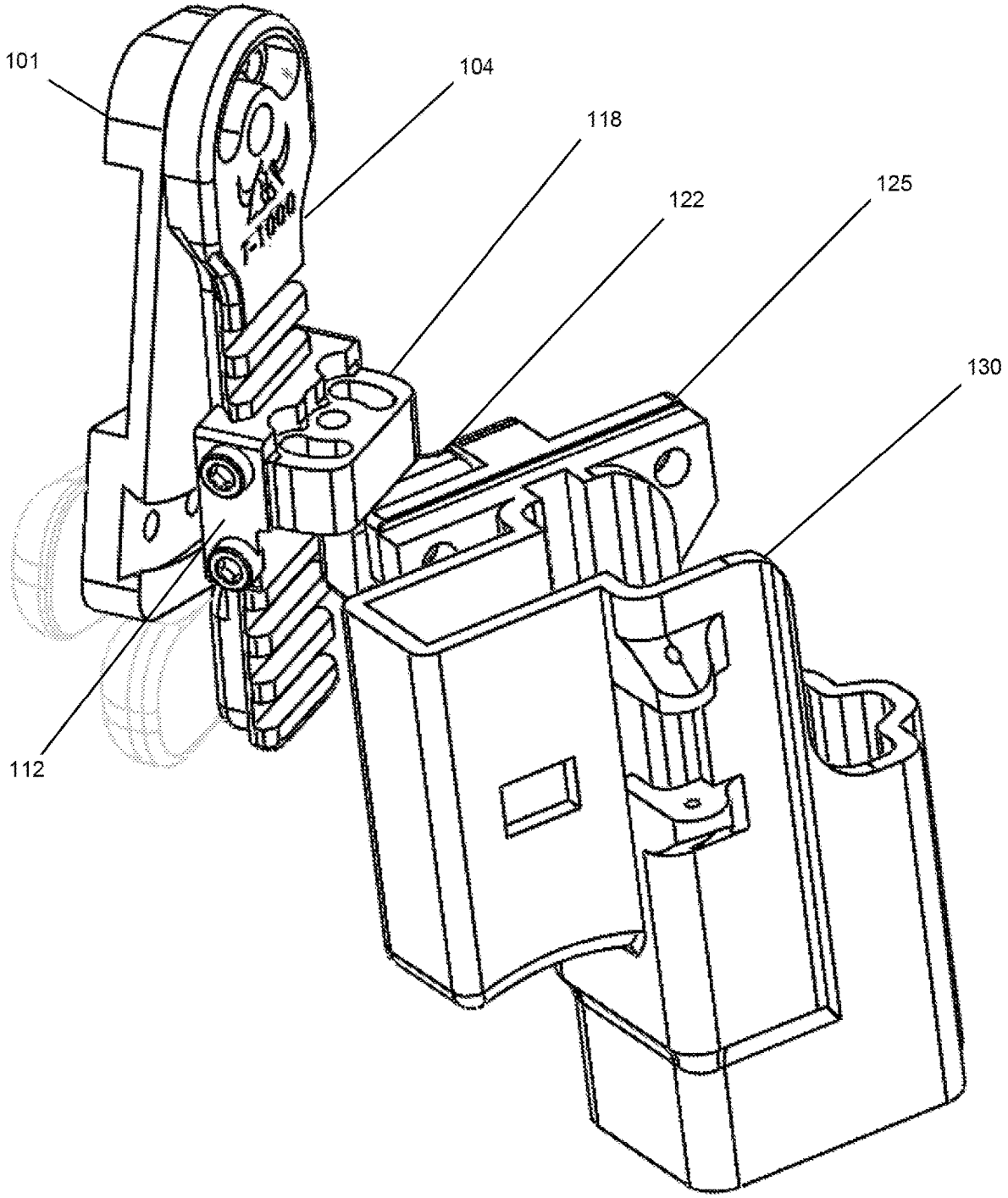
FIG. 9: shows a perspective view of a multi-directional adjustable holster hanger device coupled with an exemplary holster through a holster plate.
Figure 10:
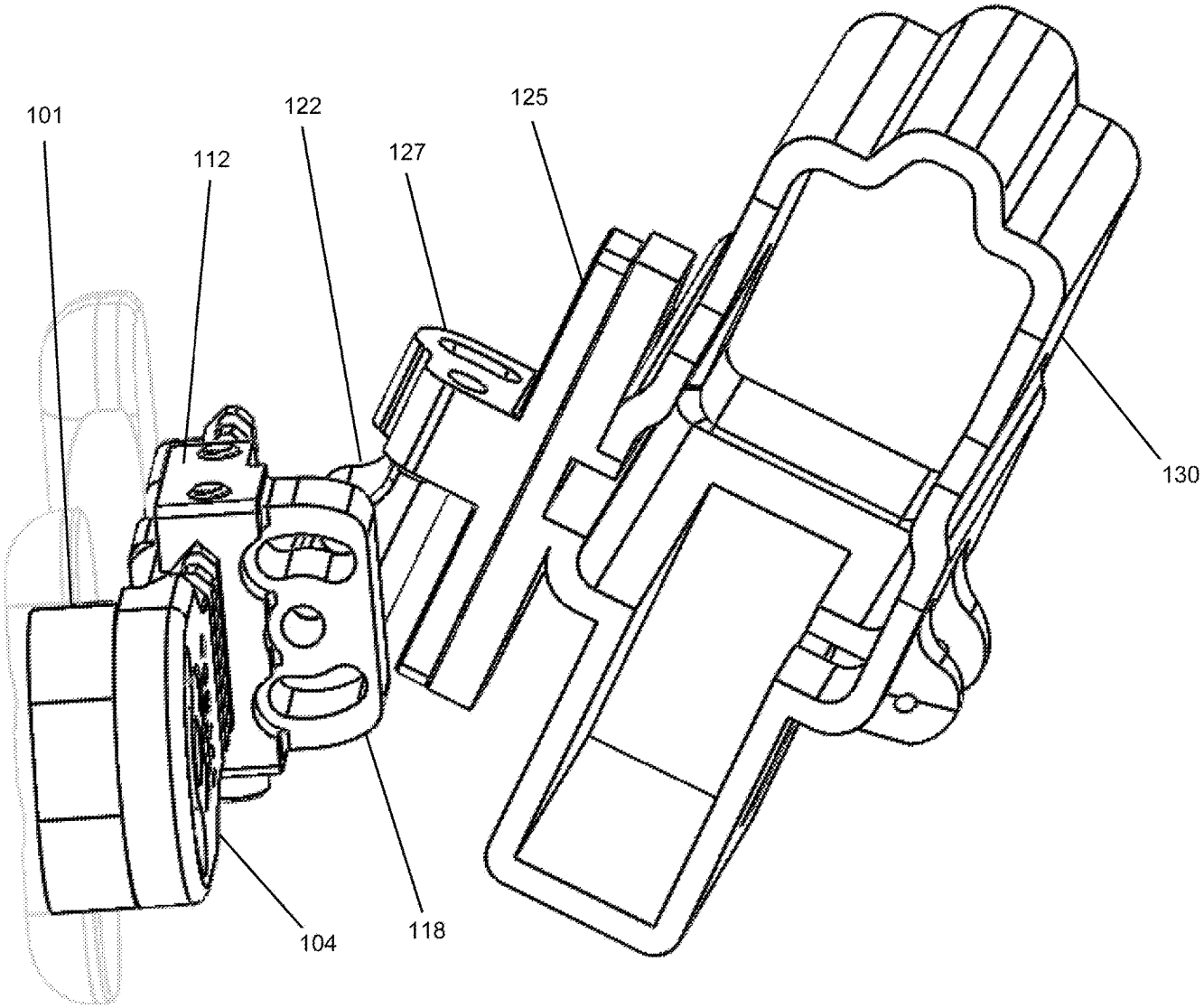
FIG. 10: shows a top view of a multi-directional adjustable holster hanger device coupled with an exemplary holster through a holster plate.

Again referring to the embodiment shown in FIG. 4, the camber joint (126) of the invention can further include a camber channel (132), preferably positioned on a camber arm (127) that can be positioned adjacent to a camber aperture (128) on the camber adaptor (122). In this configuration, a fastener or pin can be inserted through the camber channel (132) and positioned within a camber aperture (128) on the camber adaptor (122). In this manner, the holster plate (125) traverses along the camber channel (132) generating the cambered movement of the holster plate (125) relative to said base (101). In this embodiment the holster plate (125) of the invention can rotate around the camber pivot (133) along the traverse distance of the camber channel (132), such that as the holster plate (125) rotates outward or inward along pathway D. The camber channel (132) moves along pathway D until a fastener, or other similar pin or coupler positioned through the camber channel (112) and secured to the camber adaptor (122) mechanically restricts further movement along pathway D. In this configuration, the length or traverse of the camber channel (112) can determine the limits of cambered movement of the =holster plate (125). As shown in FIGS. 8-10, a holster (120) can be secured to the holster plate (125) of the invention through one or more holster coupler positions (130).

Notably, while the toe adaptor (118), rail adaptor (112), and camber adaptor (122) are shown as separate components, in certain embodiments two or more of the adaptors of the invention can form an integral component, while is still further embodiments, all three adaptors form a unitary component that can be secured to the arm (104) of the invention.

The present invention include an adjustable holster hanger (200) device. In one embodiment, the multi-directional adjustable holster hanger (200) device includes a base (201) coupled with an arm (204) through a caster joint (210). Additional embodiments include an adaptor (214) coupled with the arm (204) through a rail joint (216). Further embodiments include an adaptor (214) that is responsive to the holster plate (222) through a toe joint (219).

In the embodiment shown in FIGS. 11-17, the adjustable holster hanger (200) of the invention includes a base (201). In this preferred embodiment, the base (201) of the invention includes an elongated plate component, preferably made of metal, plastic, or other composite material that can be secured to a user, preferably through a coupler device, such as a clip, or other similar coupling device known or used to secure a holster (not shown) to a user. In this configuration, the base can be secured to a user's clothing on either the right or left hand side according to the dominant or draw hand of the user.

Figure 12:
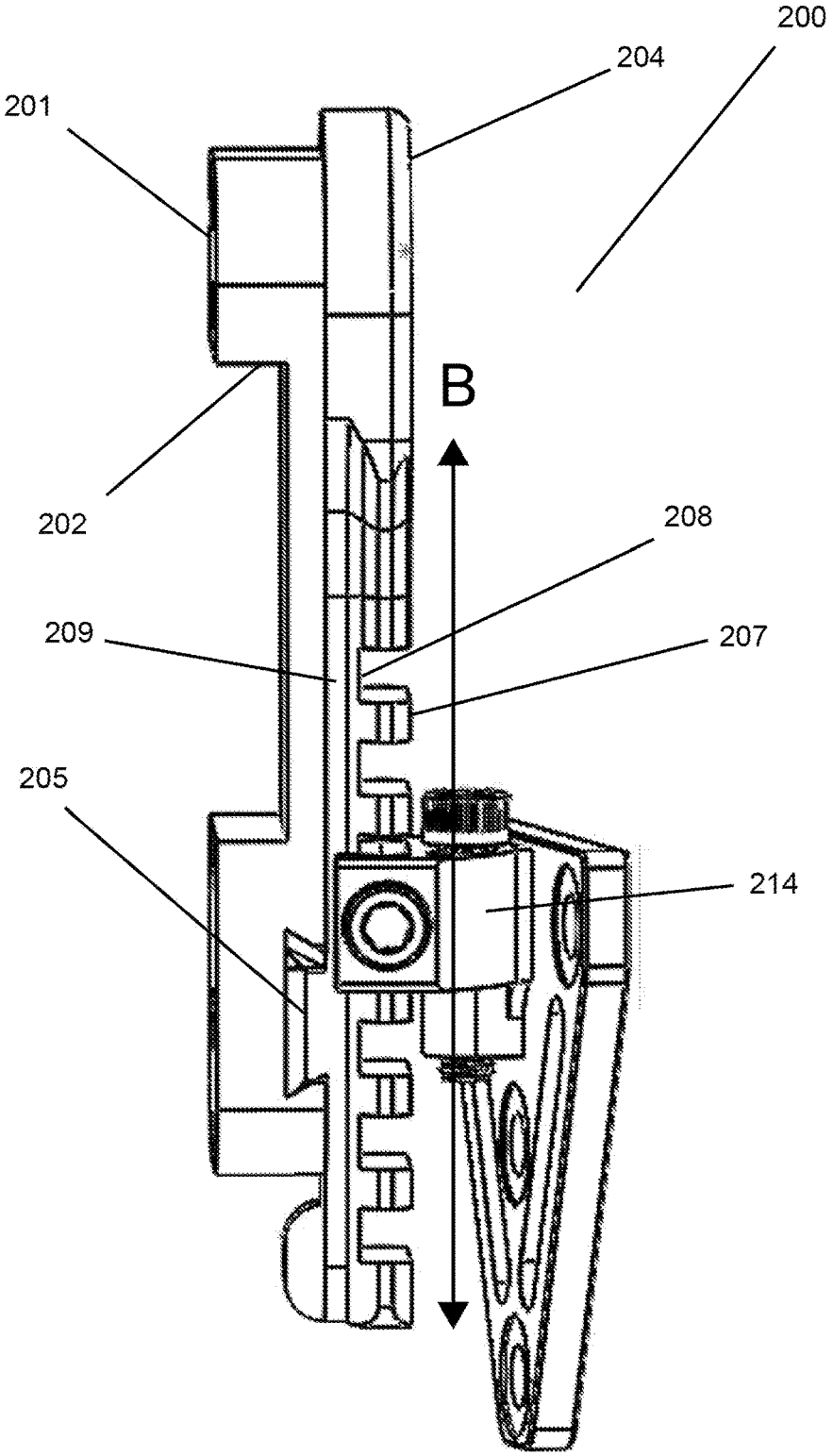
FIG. 12: shows a side view of an adjustable holster hanger device with the arm rotated into a forward position and a holster plate positioned with an toe angle approximately flush with the arm in one embodiment thereof.

The base (201) of the invention includes a belt channel (202). In the embodiment shown in FIG. 12, a belt channel (202) can include an integral channel positioned horizontally along the rearward surface of the base (201). In this embodiment, a belt or other similar article can be positioned within the belt channel (202) and secured by one or more belt loops (not shown). Again, as shown in FIG. 12, the belt loop (not shown) of the invention can include a rigid bar extending across the belt channel (202). In this embodiment, a belt or other similar article can be positioned within the belt channel (202) and secured therein by one or more of the belt loops (not shown), which can be compressed against the belt or other article by one or more fasteners, such as a threaded coupler. Further, in this embodiment a user can release the belt or other article by loosening the fasteners, thereby removing the compression against the belt. In this manner a user can secure the base (201) of the invention in a position that is optimal, or the most comfortable for a rapid and fluid removal, or "drawing" of the firearm secured within a holster (not shown) as described below.

Figure 11:
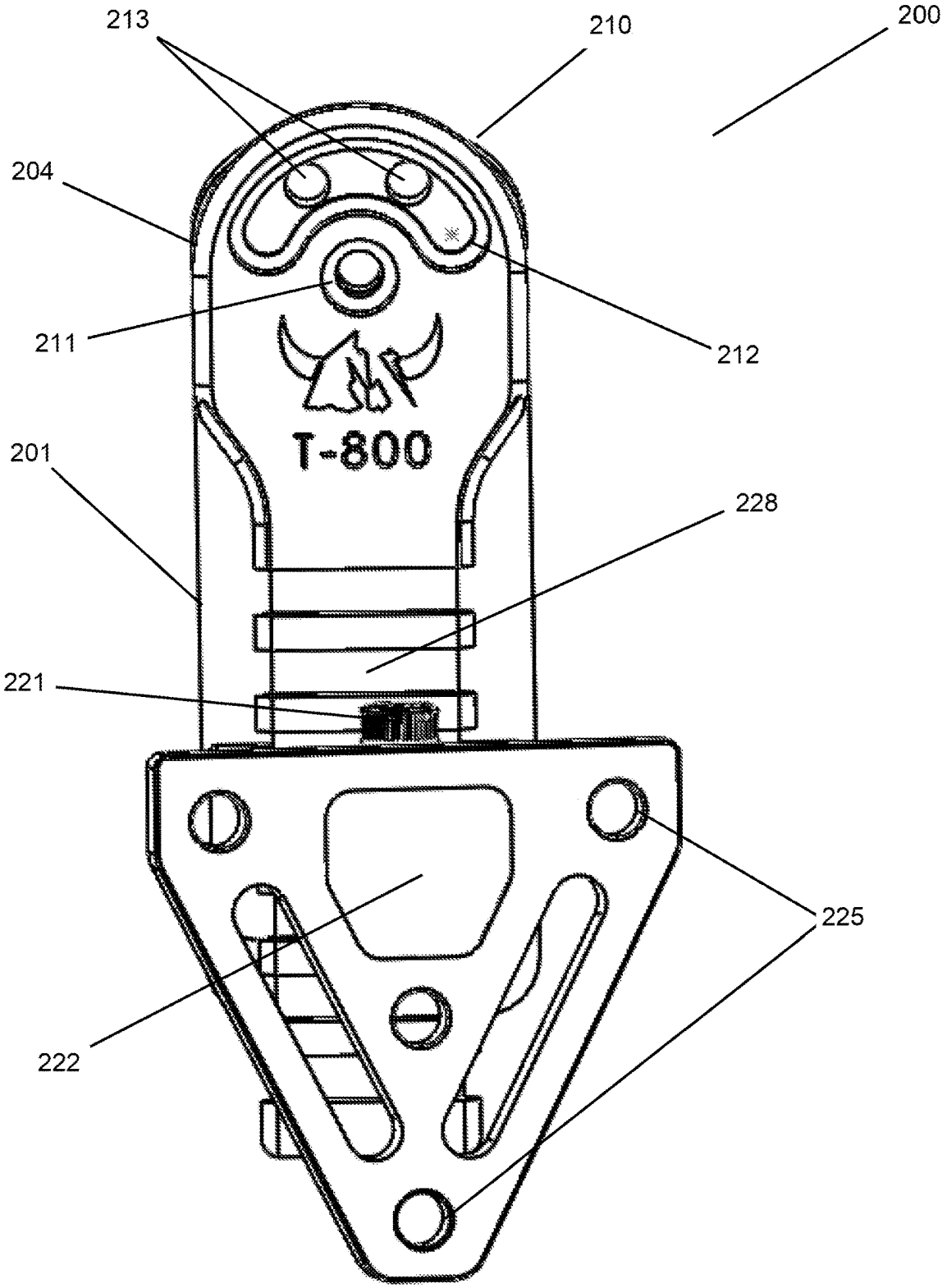
FIG. 11: shows a front view of an adjustable holster hanger device with the arm rotated into a forward position and a holster plate positioned with an toe angle approximately flush with the arm in one embodiment thereof.

The adjustable holster hanger (200) of the invention can be configured to allow the rotational coupling of an arm (204) with the base (201) of the invention. In the preferred embodiment shown in FIGS. 12-17, the arm (204) of the invention can include an elongated plate component, preferably made of metal, plastic, or other composite material that can be positioned approximately flush with the base (201), and further be rotatably coupled with the base (201) through a caster joint (210). As used herein, a caster joint (210) generally refers to a rotatable coupling between the base (201) and the arm (204) that is configured to allow rotation of the arm (204) along an approximately parallel plane relative to the base (201) which is shown in FIG. 11 as the rotational direction (A). In a preferred embodiment, the caster joint (210) of the invention is coupled to the top front surface of the base (201) and can be further configured to rotate along an axis that is perpendicular to the top portion of the base (201) allowing rotation of the arm (204) relative to the base (201) in an approximately parallel plane relative to the base (201). In this embodiment, the perpendicular axis can be positioned at a caster pivot (211). In this embodiment, the caster pivot (211) of the invention can include a position where the arm (204) and base (201) of the invention can be rotatably coupled.

As shown in FIGS. 11-17, generally the caster pivot (211) of the invention can include an aperture on the arm (204) of the invention. A fastener (not shown), or other coupler such as a pin can be inserted through the aperture and secured to the base (201). In a preferred embodiment, a threaded fastener can be inserted through the aperture and secured to the base (201). In this configuration, the threaded fastener can be loosened to allow rotational adjustment of the arm (204), generally referred to as caster or caster movement (A) of the arm (204). Alternatively, the threaded fastener can be tightened so as to restrict rotational adjustment of the arm (204) and prevent the castered movement of the arm (204) relative to the base (201).

In alternative embodiments of the invention, the caster joint (210) of the invention can further include a caster channel (212). As shown in FIGS. 11-17, the caster channel (212) of the invention can include an extended aperture on the upper portion of the arm (204). When the base (201) and arm (104) are positioned adjacent to one another, one or more caster apertures (213) on the base (201) can be accessible through the caster channel (212). In this configuration, the arm (204) can be secured to the base (201) through a fastener, and can further be locked into a position relative to the base (201) through a fastener inserted into a caster aperture (213) on the base (201) that is accessible through the caster channel (212) of the arm (204). The fastener (not shown) can preferably include a threaded fastener that can secure the arm (204) and base (201) through the caster channel (212). In this configuration, the threaded fastener can be loosened so as to become disengaged from the caster aperture (213) on the base (201) thereby allowing rotational adjustment of the arm (204) along pathway A as described above. Alternatively, the threaded fastener(s) can be tightened so as to become engaged with the caster aperture (213) on the base (201) thereby generating a compression force against the arm (204) and restricting its rotational adjustment relative to the base (201).

As can be appreciated, in certain embodiments the caster joint (210) can be configured to allow full rotational movement, or a full 360° degrees rotational movement of the arm (204) relative to the base (201). However, in the preferred embodiment shown in FIGS. 11-17, the rotation of the arm (204) relative to the base (201) can be restricted. Specifically, in this embodiment, the arm (204) of the invention can rotate around the caster pivot (211) along the traverse distance of the caster channel (212). So, for example as the arm (204) rotates forward, the caster channel (212) of the arm rotates along pathway A until it contacts a fastener, or other similar pin or coupler positioned through the channel (212) and secured to the base (201) that mechanically restricts further rotational movement along pathway A. In this configuration, the length or traverse of the channel can determine the limits of forward or reverse rotational movement, or caster of the arm (204) relative to the base (201).

The adjustable holster hanger (200) of the invention can be configured to allow the vertical adjustment (B) of a coupled holster (not shown) along the length of the arm (204). In this embodiment, an adaptor (214) can be configured to be coupled with the arm (204) and further be adjustably positioned along the length of the arm (204) according to a user's preferred or desired height along pathway B. It should be noted that the adaptor (214) of the invention may or may not include a rail coupling or even a slidable coupling. In certain embodiments, the adaptor (214) of the invention can be coupled at different positions along the length of the arm (204). Such adjustable coupling can be accomplished through clips, fasteners, or other coupling devices, such as spring couplers, slide couplers, quick release couplers, twist couplers, and the like.

In the preferred embodiment shown in FIGS. 11-17, the adaptor (214) of the invention can include a component formed of metal, plastic, or other composite material that can be slidable coupled with said arm (204) through a rail joint (216). In this configuration, the rail joint (216) of the invention allows the adaptor (214) to be adjustably secured along the length of said arm (204). In this manner, the positioning of the adaptor (214) along the arm (204) of the inventions allows a responsive holster (not shown) to be positioned, relative to a user, in the most comfortable or optional height configuration for a rapid and fluid removal, or "drawing" of the firearm secured within the holster (not shown).

Again referring to FIGS. 11-17, the adaptor (214) of the invention can be slidably secured to a rail positioned on the arm (204) of the invention. In this embodiment, the adaptor (214) may include a rail interface (215) that is configured to slidably engage with the rail (209). In this embodiment, the rail interface (215) and rail (209) form a dovetail joint that allows the adaptor (214) to slide along the length of the arm (204). In this embodiment, the front surface of the arm (204) of the invention can include a mounting surface (228). In a preferred embodiment, the mounting surface (228) of the invention can be configured to provide one or more mounting positions to allow the adaptor (214) to be secured to the arm (204). As shown in the embodiment of FIGS. 11-17, the mounting surface (204) can include a plurality of steps (207) and grooves (208) forming a picatinny rail surface. As noted above, numerous methods of securing a adaptor (214) to a picatinny rail surface are known in the art.

Referring again to FIGS. 11-17, the adaptor (214) of the invention can be secured to the arm (204) through one or more fasteners, and preferably a threaded coupler. In this preferred embodiment, a rail fastener (218) can be inserted into a corresponding rail aperture (217) on the adaptor (214) of the invention. In this configuration, the rail fastener (218) is inserted into a groove (208) of the mounting surface (228) and secured within the channel of the groove (208) by adjacent steps (207). In a preferred embodiment, the rail fastener (218) includes a threaded coupler that can be secured with a threaded portion of the rail aperture (217).

In another embodiment, the base (201) of the invention can include a slot (203) configured to be slidably coupled with a pin (205) on said arm (204) forming a slide joint (206). As shown in FIG. 11, in a preferred embodiment the slot (203) of the invention includes an integral channel on the front surface of the base (201). The pin (205) of the invention includes an extension extending rearward from the arm (204). As shown in FIGS. 11-12, the slot and extension can form a sliding dovetail connection that can further be arched to match the rotation of the arm (204) along pathway B as described herein. In this configuration, the rotational movement of the arm (204) can be laterally stabilized by the sliding engagement of the slot (203) and pin (205).

The multi-directional adjustable holster hanger (200) of the invention can be configured to allow the outward or inward swinging adjustment (C), also referred to as the toe or toe movement, of a coupled holster (not shown) in relation to the arm (204). In this embodiment, an adaptor (214) can be configured to form a toe joint (219) that is responsive to the holster plate (222) allowing adjustment of the toe angle of the holster plate (222) along pathway C as shown in FIGS. 11-13, relative to the base (201).

Figure 13:
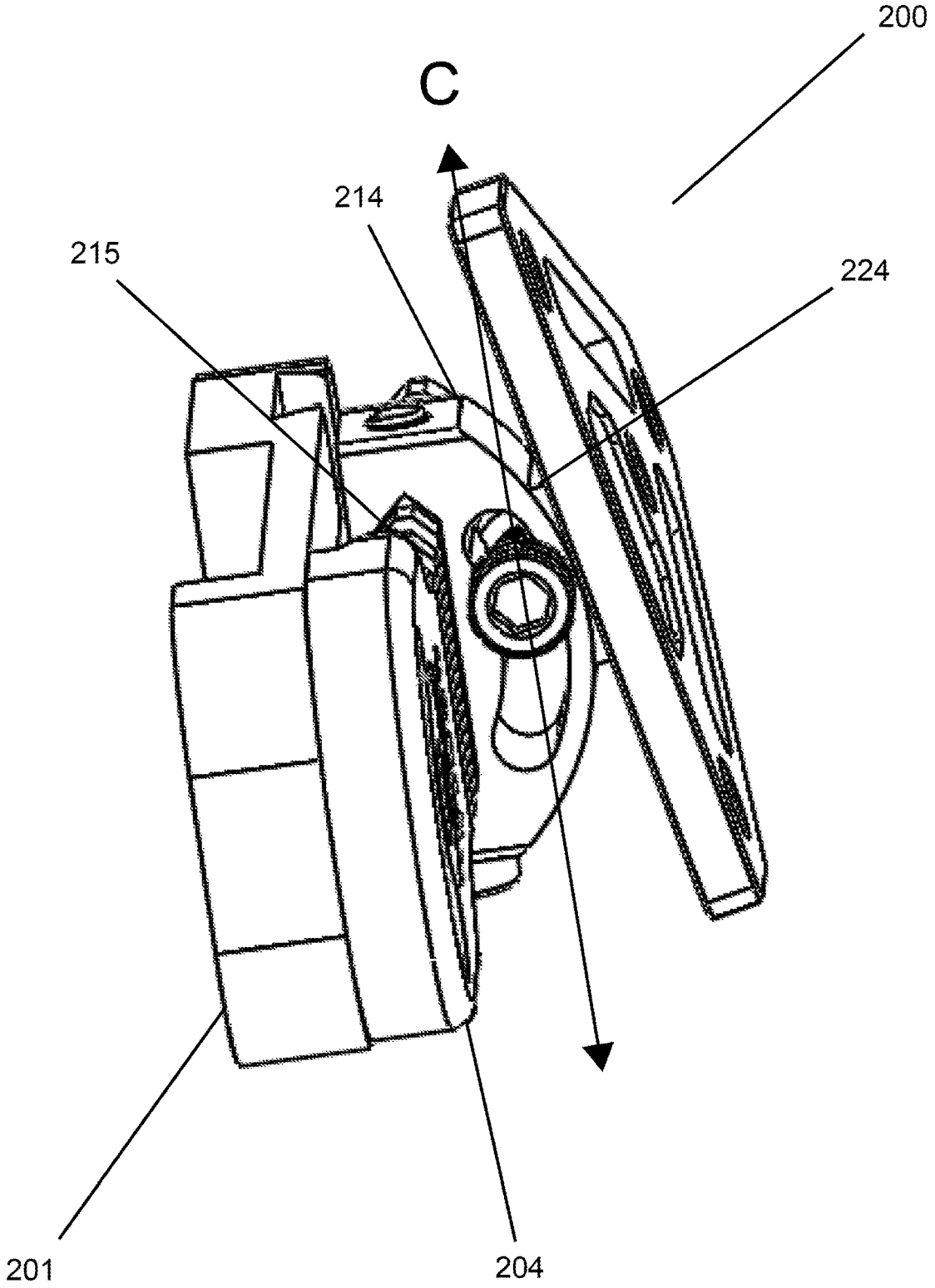
FIG. 13: shows a top perspective view of an adjustable holster hanger device with the arm rotated into a forward position and a holster plate coupled with an adaptor through a toe joint and positioned with an inward extended toe angle in one embodiment thereof.
Figure 14:
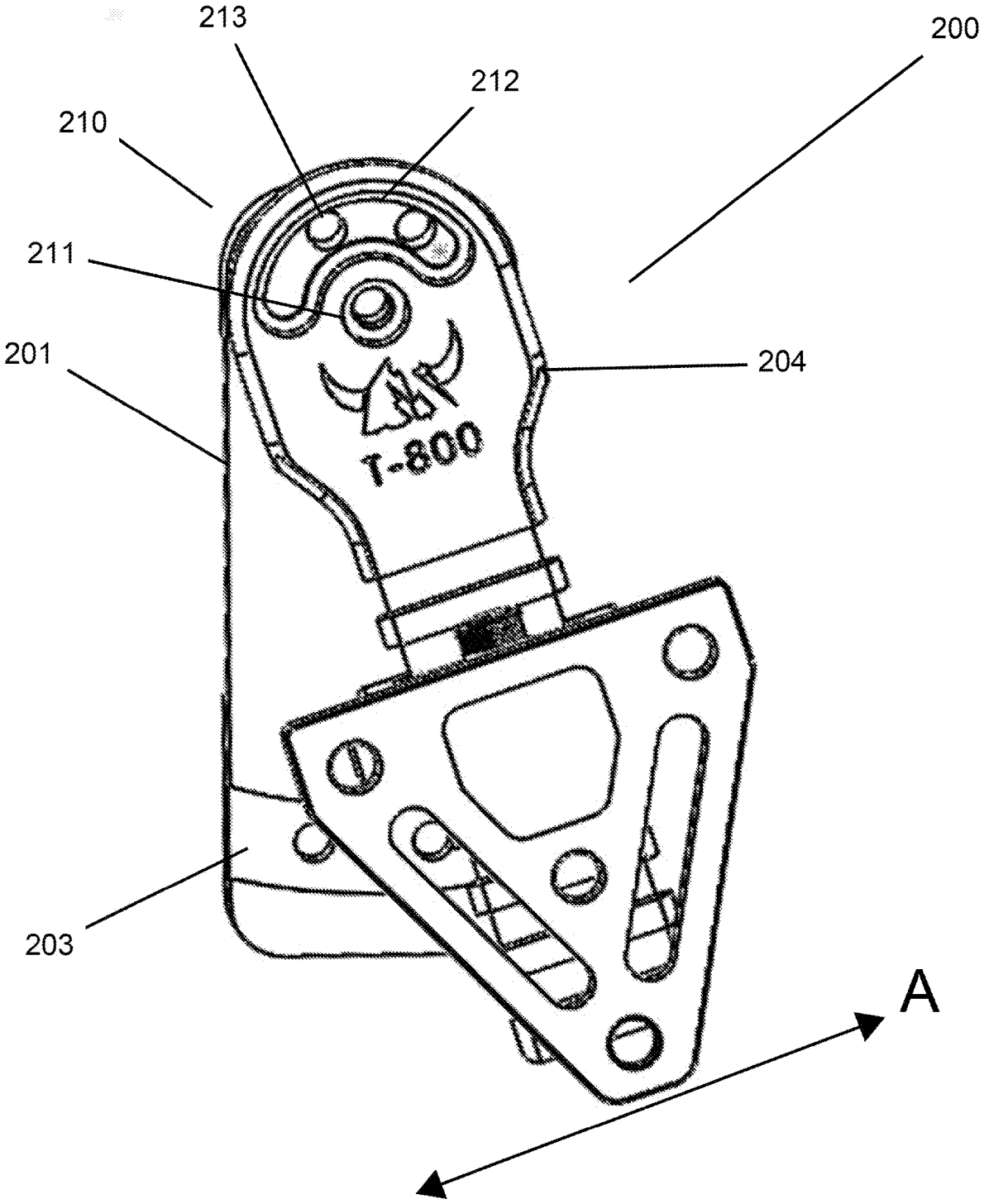
FIG. 14: shows a front view of an adjustable holster hanger device with the arm rotated into a forward position and a holster plate positioned with an toe angle approximately flush with the arm in one embodiment thereof.
Figure 15:
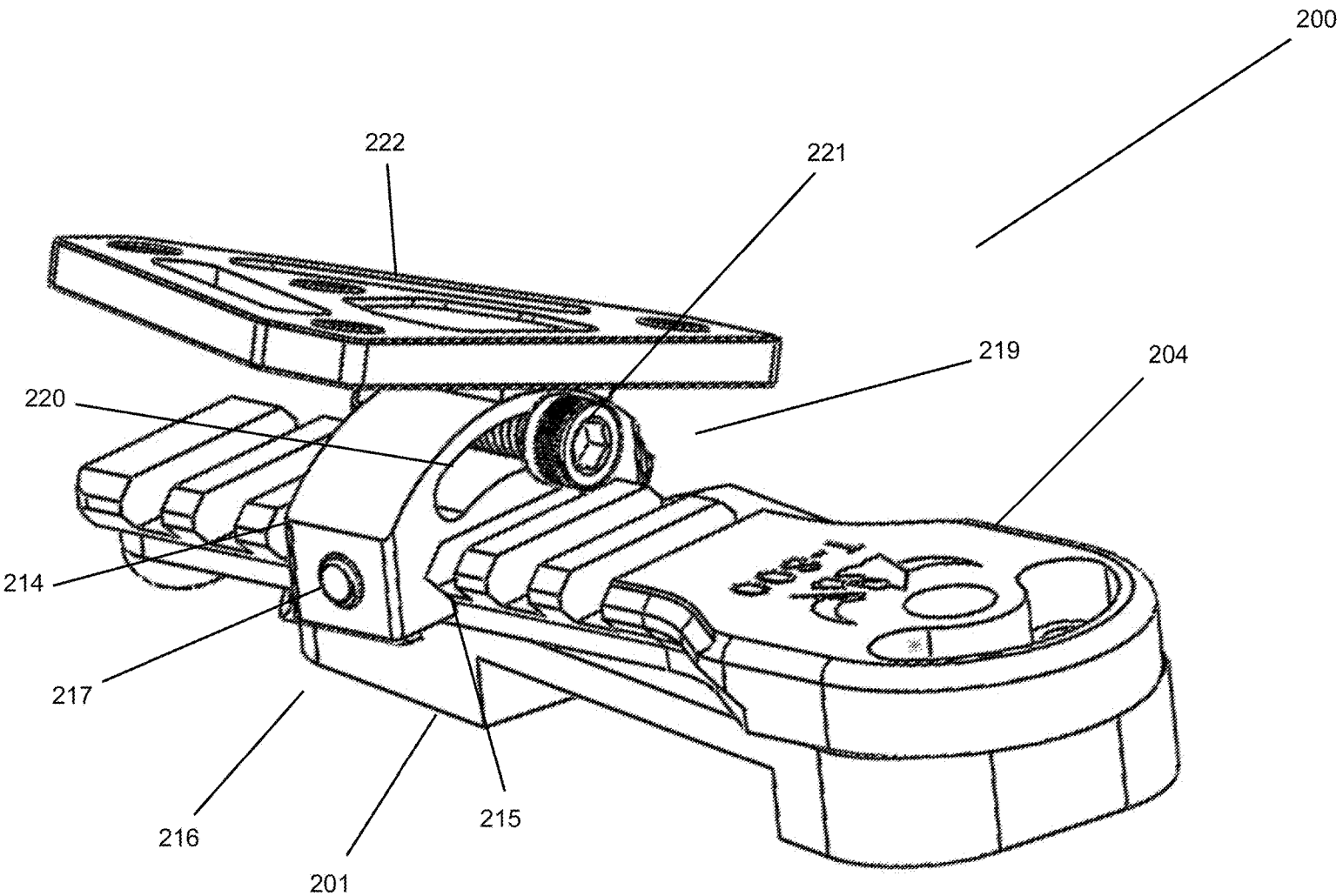
FIG. 15: shows a top perspective view of an adjustable holster hanger device with the arm rotated into a forward position and a holster plate coupled with an adaptor through a toe joint and positioned with an outward extended toe angle in one embodiment thereof.
Figure 16:
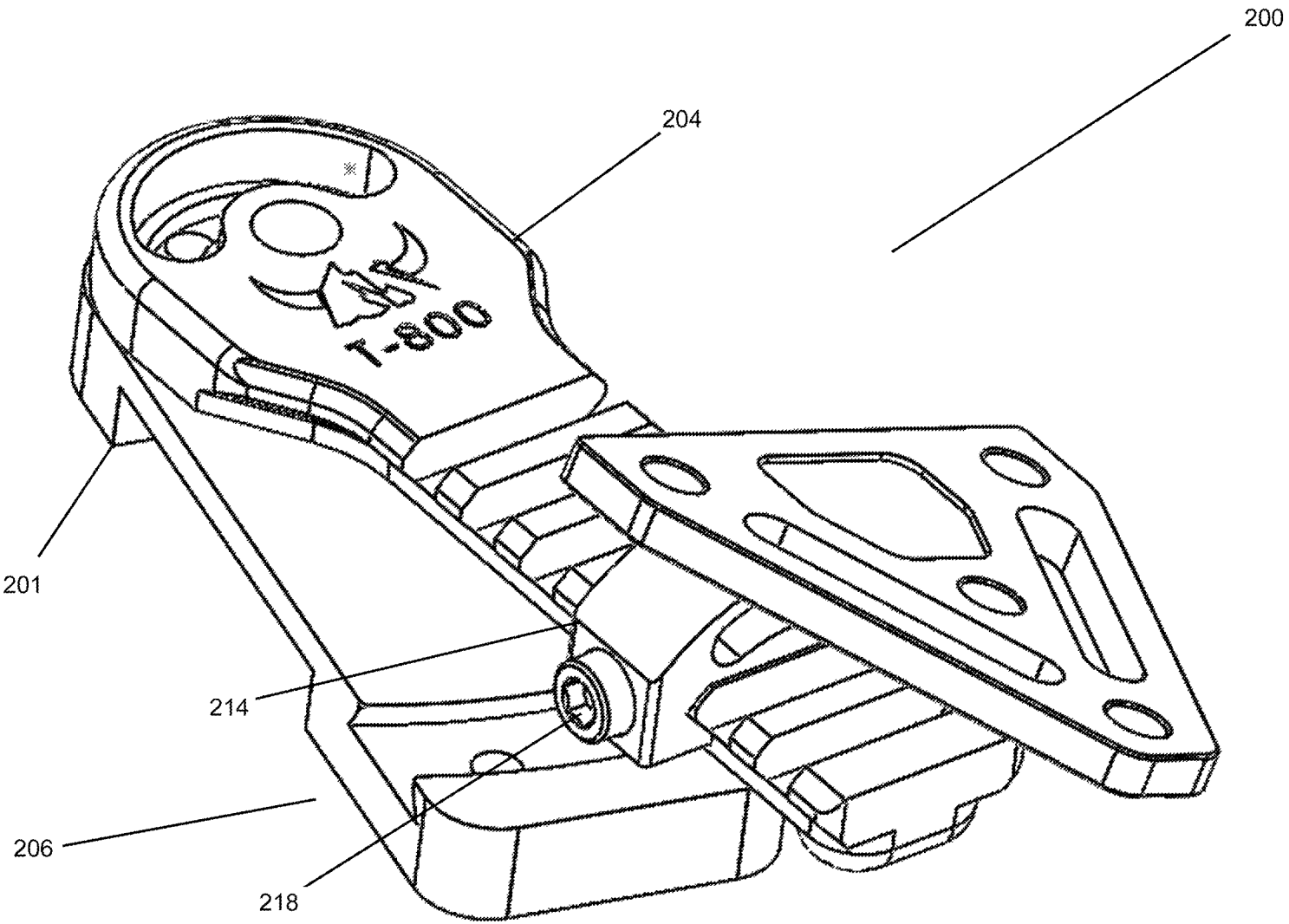
FIG. 16: shows a bottom perspective view of an adjustable holster hanger device with the arm rotated into a forward position and a holster plate coupled with an adaptor through a toe joint and positioned with an inward extended toe angle in one embodiment thereof.
Figure 17:
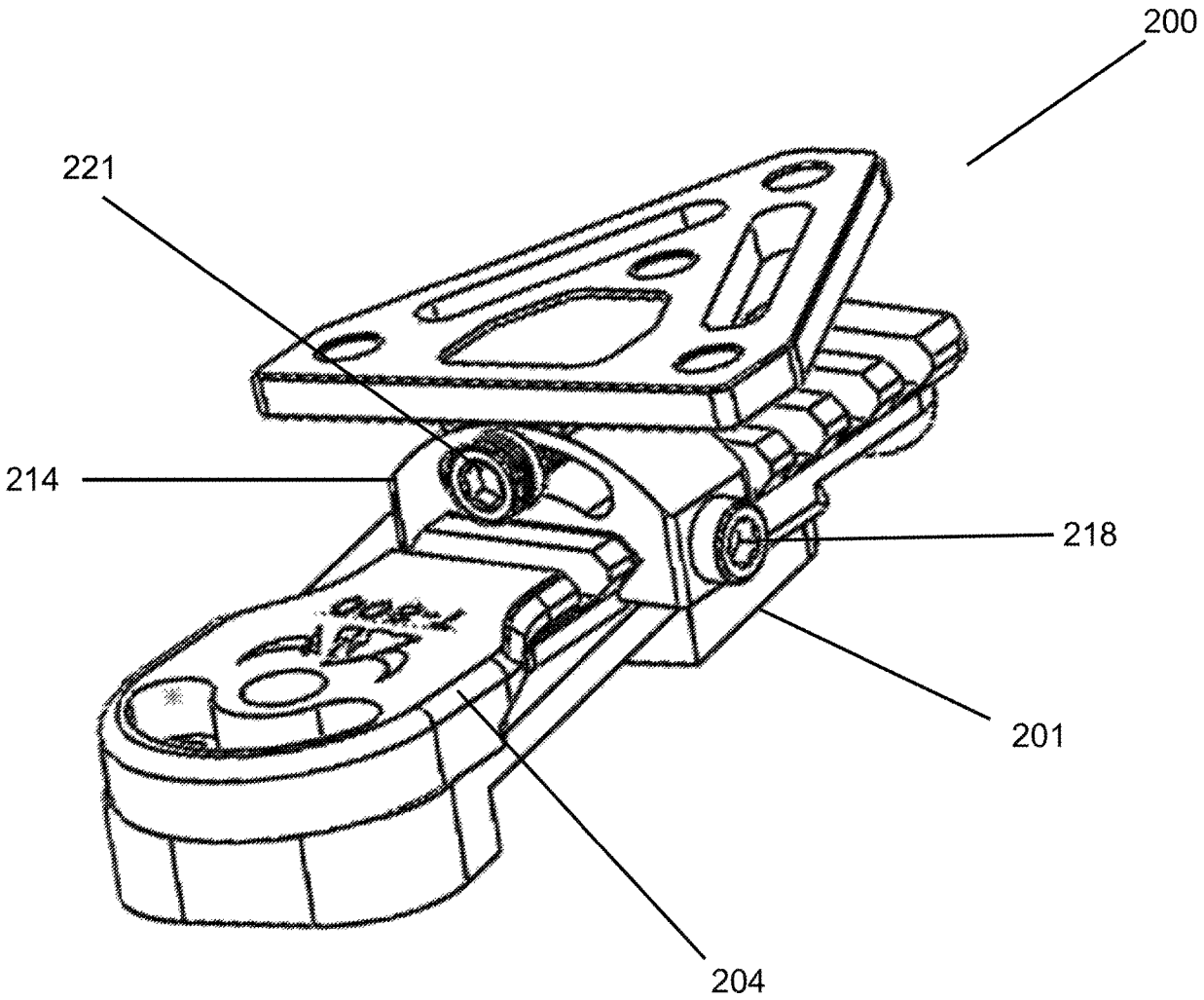
FIG. 17: shows a top perspective view of an adjustable holster hanger device with the arm rotated into a forward position and a holster plate coupled with an adaptor with an toe angle approximately flush with the arm in one embodiment thereof.

As shown in FIGS. 11-17, the adaptor (214) of the invention can include a component, preferably made of metal, plastic, or other composite material that is configured to be positioned on the front surface of the arm (214). In this configuration, a holster plate (22) can be adjustably coupled to the adaptor (214) through a toe joint (219) allowing adjustment of the toe angle of the holster plate (125) along pathway C as shown in FIG. 13. In the preferred embodiment shown in FIGS. 11-17, the toe joint (219) joint of the invention can include a toe fastener (221), such as a threaded coupler or pi, positioned within a toe channel (222) on the adaptor (214) which can further be coupled with a toe coupler (223) on the holster plate (125). In another preferred embodiment, a toe slide (224) can be positioned adjacent to the adaptor (214) and be configured to be approximately flush with the surface of the adaptor (214) so as to form a slidable coupling between the two components to support the holster plate (222) as it traverses pathway C as shown in the Figures.

As shown in FIG. 12, the toe angle of the holster plate (125) relative to the base (201) is adjustable along the traverse distance of said toe channel (222). For example as the holster plate (125) moves along pathway C and away from the base and user's body, the toe fastener (221) secured by the to the toe coupler (223) and positioned within the toe channel (220) slides along pathway C until the toe fastener (221) contacts the end of the toe channel (220) which mechanically restricts further movement along pathway C. In this configuration, the length or traverse of the toe channel (220) can determine the limits of the toe angle the holster plate (125) relative to the base (201).

Notably, while the adaptor (214) and holster plate (222) are shown as separate components, in certain embodiments two or more of the adaptors of the invention can form an integral component.

The present invention include a rotationally adjustable holster hanger (300) device. In one embodiment, the multi-directional adjustable holster hanger (100) device includes a base (301) coupled with a rotational adaptor (303) through a caster joint (304) allowing rotation of the adaptor (303) relative to the base (301). In another embodiment, a rotationally adjustable holster hanger (300) device of the invention includes a holster plate (308) coupled to the rotational adaptor (303) through a camber joint (309) allowing cambered movement of the holster plate (308) relative to the base (301).

In the embodiment shown in FIGS. 18-23, the rotational holster hanger (300) of the invention includes a base (301). In this preferred embodiment, the base (301) of the invention includes an elongated plate component, preferably made of metal, plastic, or other composite material that can be secured to a user, preferably through a coupler device, such as a clip, or other similar coupling device known or used to secure a holster (not shown) to a user. In this configuration, the base can be secured to a user's clothing on either the right or left hand side according to the dominant or draw hand of the user.

Figure 20:
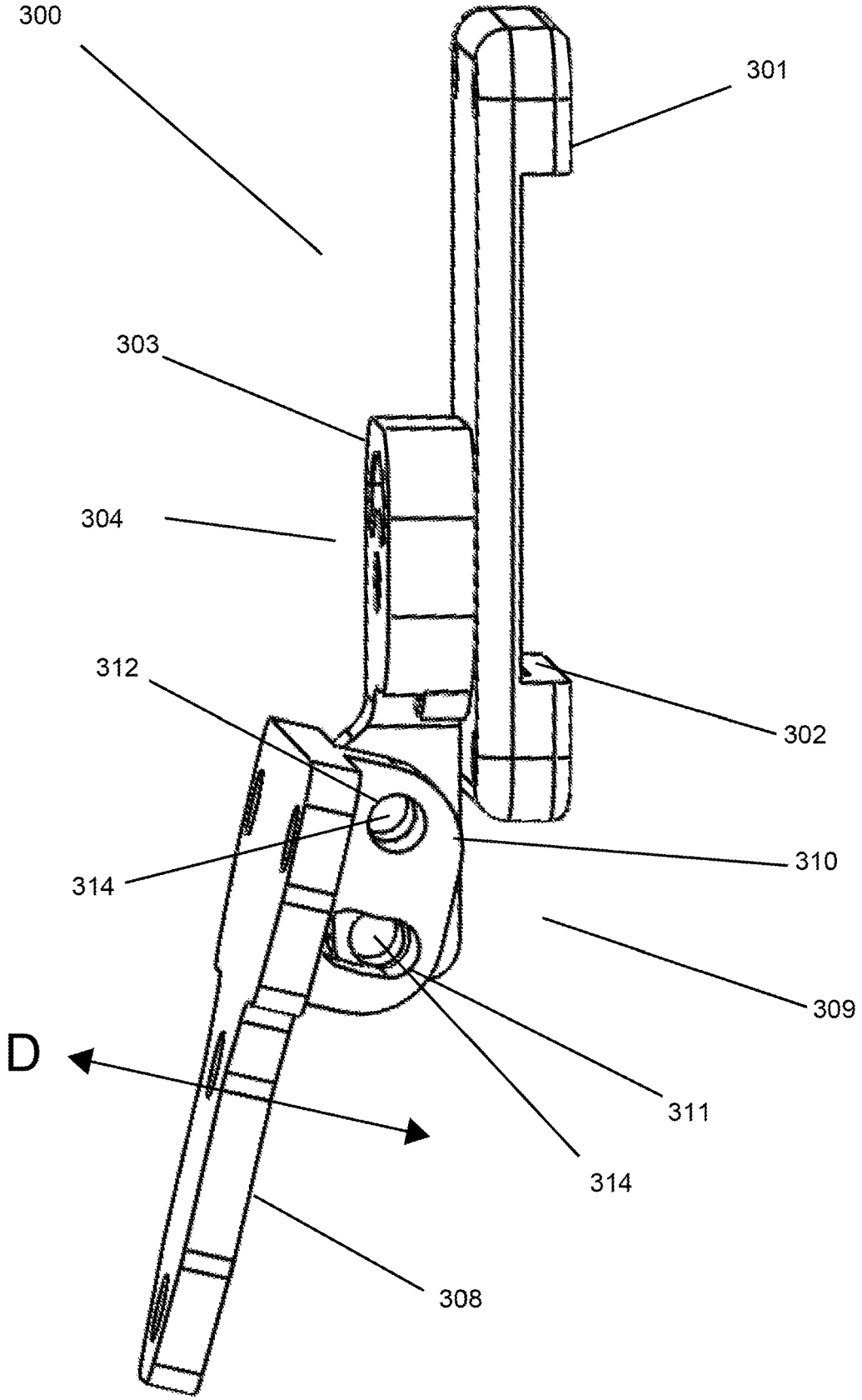
FIG. 20: shows a side perspective views of a rotationally adjustable holster hanger device with the rotational adaptor coupled with an base through a caster joint showing the holster plate rotated into a shortened position, and a the holster plate coupled with the rotational adaptor through a camber joint positioning the plate in an outward extended cambered position relative to the base in one embodiment thereof.
Figure 21:
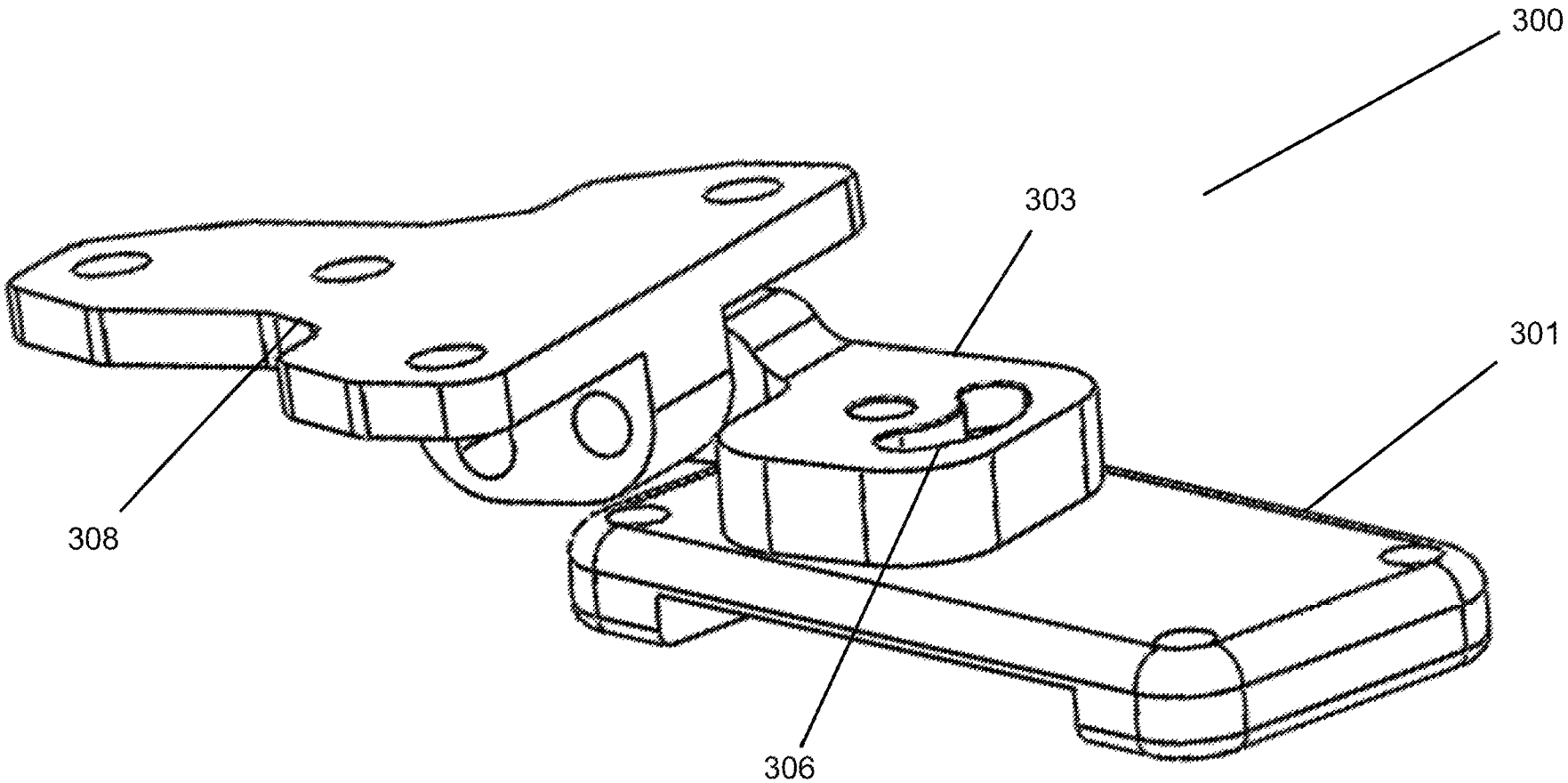
FIG. 21: shows a perspective view of a rotationally adjustable holster hanger device with a rotational adaptor coupled with an base through a caster joint positioning the holster plate in a forward rotational position in one embodiment thereof.
Figure 22:
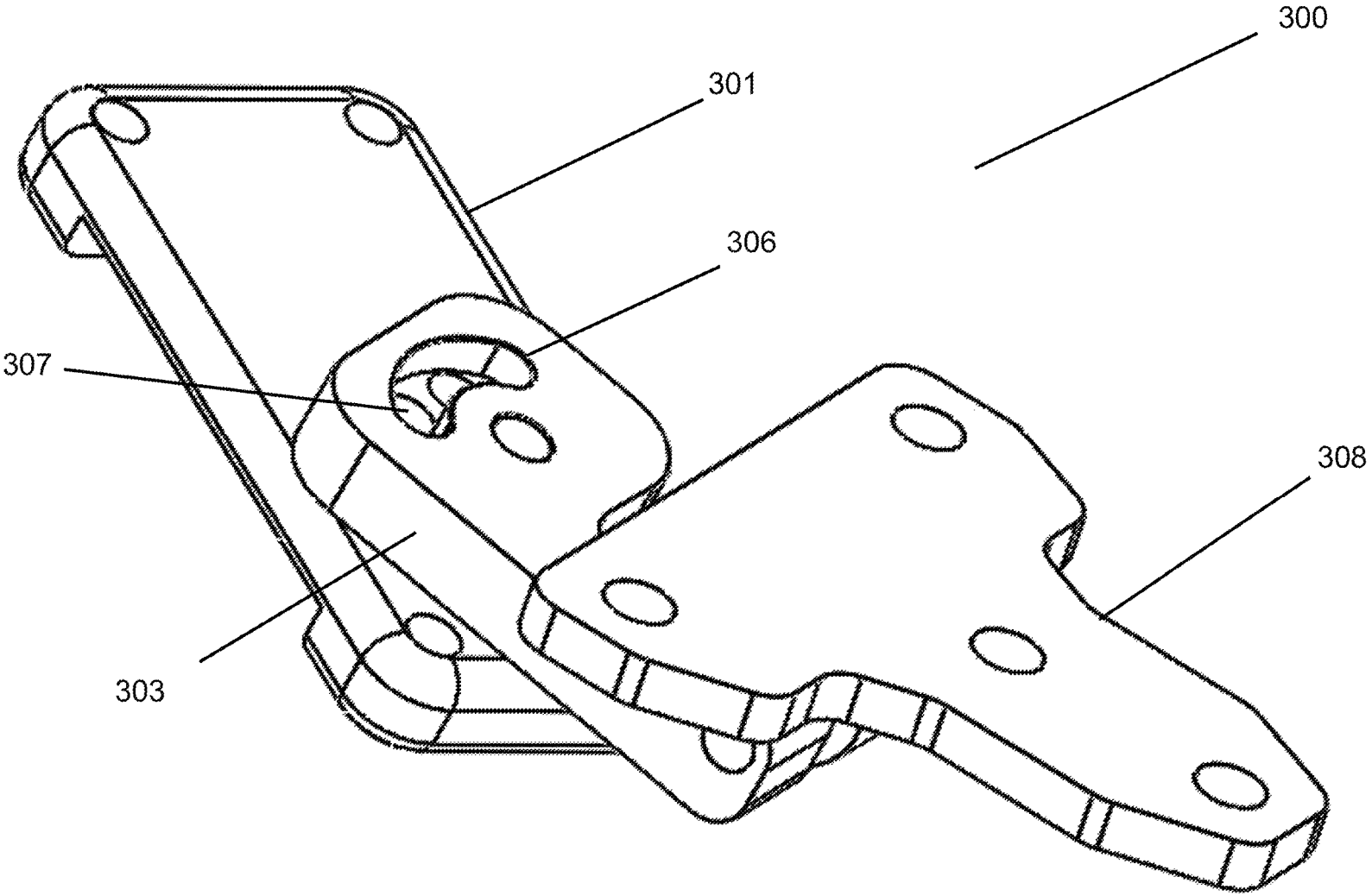
FIG. 22: shows a perspective views of a rotationally adjustable holster hanger device with the rotational adaptor coupled with an base through a caster joint showing the holster plate rotated into an extended position, and a the holster plate coupled with the rotational adaptor through a camber joint positioning the plate in an approximately flush position relative to the base in one embodiment thereof.
Figure 23:
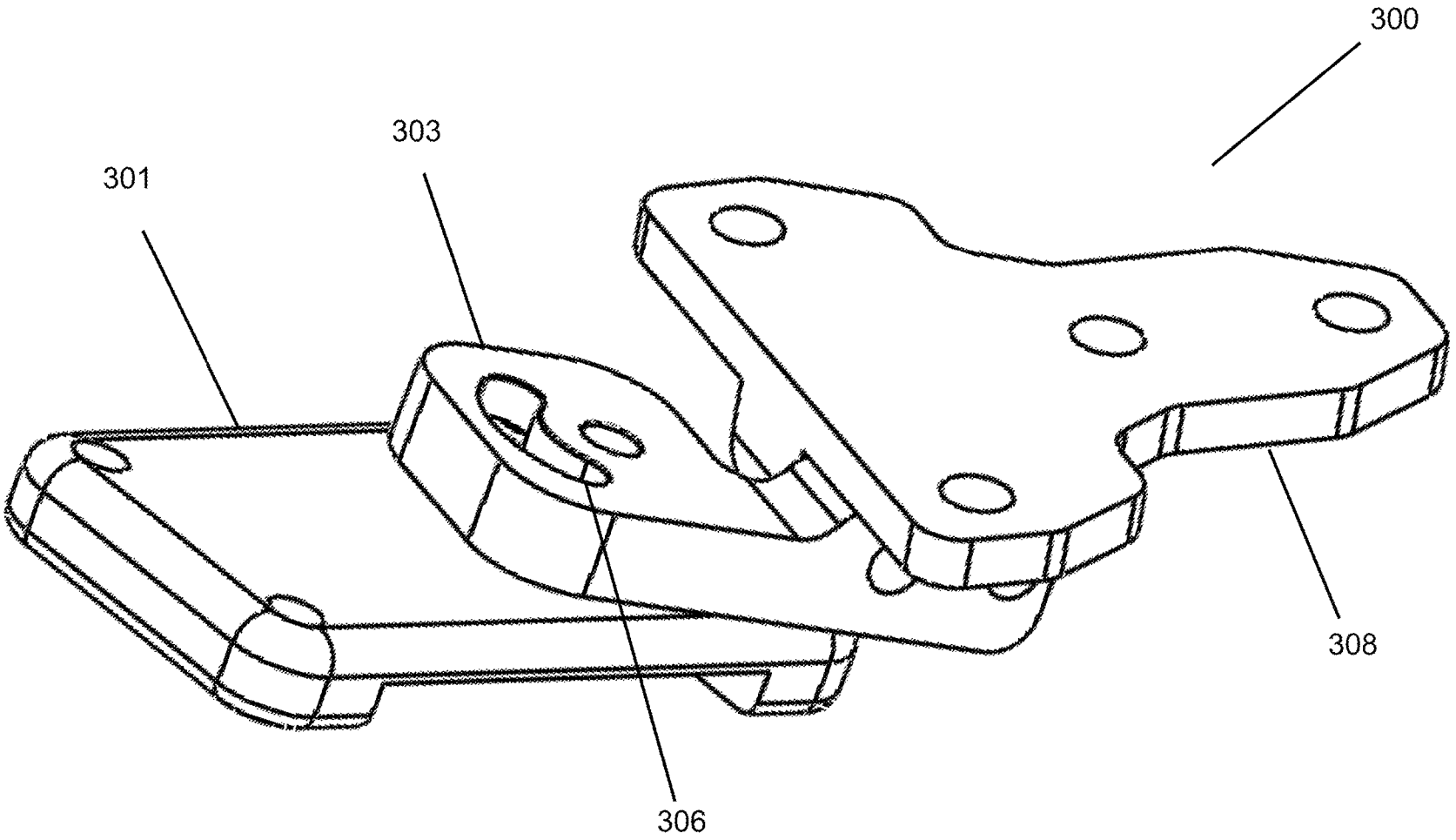
FIG. 23: shows a side perspective views of a rotationally adjustable holster hanger device with the rotational adaptor coupled with an base through a caster joint showing the holster plate rotated into a rearward and extended position, and a the holster plate coupled with the rotational adaptor through a camber joint positioning the plate in an outward extended cambered position relative to the base in one embodiment thereof.

The base (301) of the invention includes a belt channel (302). In the embodiment shown in FIG. 20, a belt channel (302) can include an integral channel positioned horizontally along the rearward surface of the base (301). In this embodiment, a belt or other similar article can be positioned within the belt channel (302) and secured by one or more belt loops (not shown). Again, as shown in FIG. 20, the belt loop (not shown) of the invention can include a rigid bar extending across the belt channel (302). In this embodiment, a belt or other similar article can be positioned within the belt channel (302) and secured therein by one or more of the belt loops (not shown), which can be compressed against the belt or other article by one or more fasteners, such as a threaded coupler. Further, in this embodiment a user can release the belt or other article by loosening the fasteners, thereby removing the compression against the belt. In this manner a user can secure the base (301) of the invention in a position that is optimal, or the most comfortable for a rapid and fluid removal, or "drawing" of the firearm secured within a holster (not shown) as described below.

Figure 18:
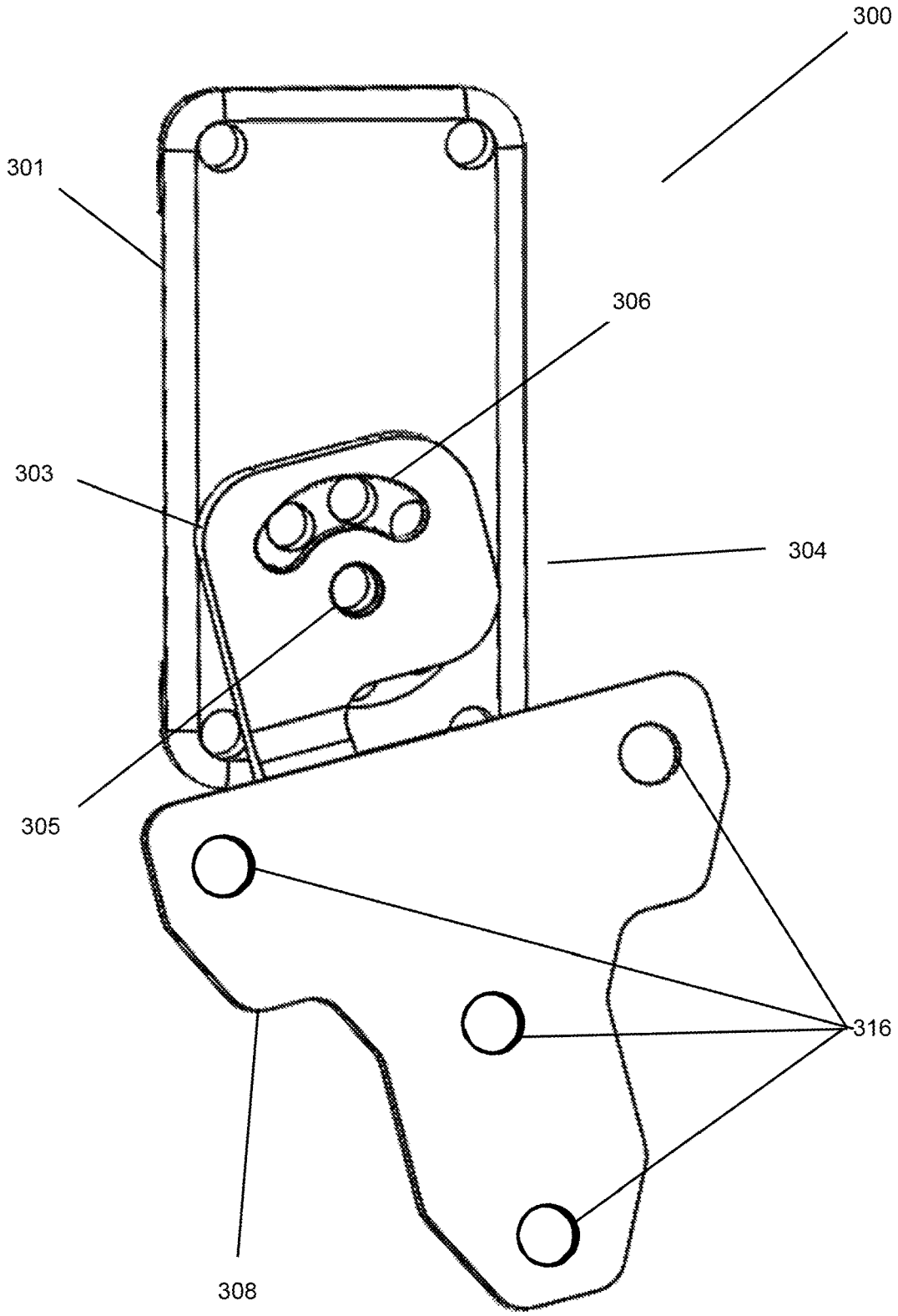
FIG. 18: shows a front view of a rotationally adjustable holster hanger device with a rotational adaptor coupled with an base through a caster joint positioning the holster plate in a forward rotational position in one embodiment thereof.

The rotational holster hanger (300) of the invention can be configured to allow the rotational coupling of a holster plate (308) with the base (101) through a rotational adaptor (303). In the preferred embodiment shown in FIGS. 18-23, the rotational adaptor (303) of the invention can include a mounting component, preferably made of metal, plastic, or other composite material that can be rotatably coupled with the base (301) through a caster joint (304). As used herein, a caster joint (304) generally refers to a rotatable coupling between the base (201) and rotational adaptor (303), that is configured to allow rotation of the rotational adaptor (303) along an pathway A relative to the base (301) as shown in FIG. 18. In a preferred embodiment, the caster joint (304) of the invention is coupled to bottom end of the base (301) and can be further configured to rotate along an axis that is perpendicular to the top portion of the base (301) allowing rotation of the rotational adaptor (303) relative to the base (301) in an approximately parallel plane relative to the base (301). In this embodiment, the perpendicular axis can be positioned at a caster pivot (305). In this embodiment, the caster pivot (305) of the invention can include a position where the rotational adaptor (303) and base (301) of the invention can be rotatably coupled.

As shown in FIGS. 18-23, generally, the caster pivot (305) of the invention can include an aperture on the a rotational adaptor (303) of the invention. A fastener (not shown), or other coupler such as a pin can be inserted through the aperture and secured to the base (301). In a preferred embodiment, a threaded fastener can be inserted through the aperture and secured to the base (301). In this configuration, the threaded fastener can be loosened to allow rotational adjustment of the rotational adaptor (303), generally referred to as caster or caster movement (A) of the arm. Alternatively, the threaded fastener can be tightened so as to restrict rotational adjustment of the arm and prevent the castered movement of the rotational adaptor (303) relative to the base (301).

In alternative embodiments of the invention, the caster joint (110) of the invention can further include a caster channel (306). As shown in FIG. 18, the caster channel (306) of the invention can include an extended aperture on the upper portion of the rotational adaptor (303). When the base (301) and arm (104) are positioned adjacent to one another, one or more caster apertures (307) on the base (301) can be accessible through the caster channel (306). In this configuration, the rotational adaptor (303) can be secured to the base (301) through a fastener, and can further be locked into a position relative to the base (301) through a fastener inserted into a caster aperture (307) on the base (301) that is accessible through the caster channel (306) of the arm (104). The fastener (not shown) can preferably include a threaded fastener that can secure the rotational adaptor (303) and base (301) through the caster channel (306). In this configuration, the threaded fastener can be loosened so as to become disengaged from the caster aperture (307) on the base (301) thereby allowing rotational adjustment of the rotational adaptor (303) along pathway A as described above. Alternatively, the threaded fastener(s) can be tightened so as to become engaged with the caster aperture (307) on the base (301) thereby generating a compression force against the rotational adaptor (303) and restricting its rotational adjustment relative to the base (301). As can be appreciated, in certain embodiments the caster joint (304) can be configured to allow full rotational movement, or a full 360° degree rotational movement of the rotational adaptor (303) relative to the base (301).

Figure 19:
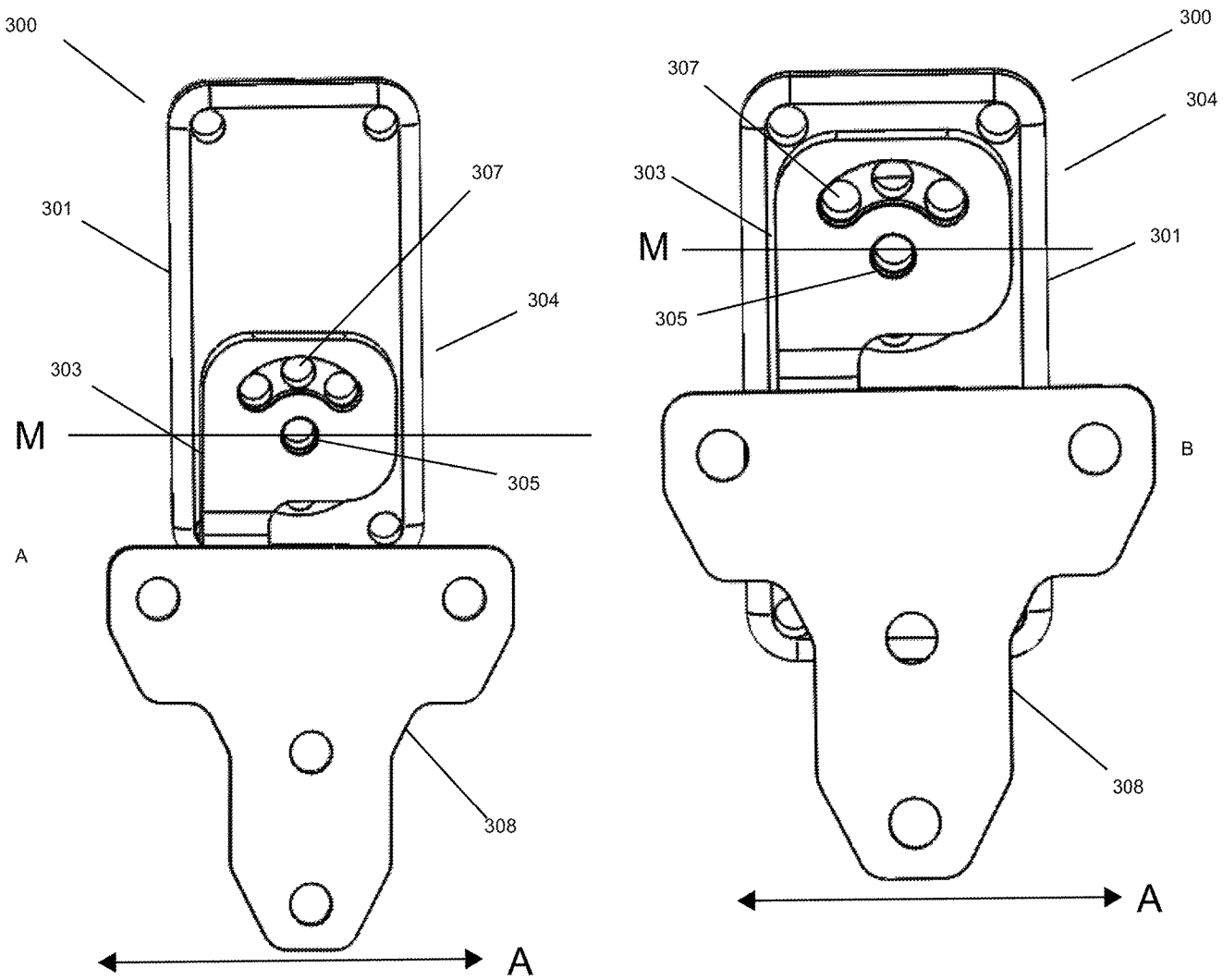
FIG. 19: shows side-by-side front views of rotationally adjustable holster hanger devices with the rotational adaptor coupled with an base through a caster joint showing the holster plate rotated into an (A) extended and (B) shortened position in one embodiment thereof.

In one preferred embodiment shown in FIG. 19, the caster joint (304) can be positioned at one end of said base (301) such that the rotational adaptor (303) can be rotated and locked into an extended position (318*a*) where the coupled holster plate (308) is positioned below a midline (M), which can be a line drawn through the caster pivot (305) and perpendicular to the base (301) through the. This extended position (318*a*) allows the coupled holster (not shown) to be positioned lower on the body of a user which may accommodate an extended or more distal position from which to draw a firearm. Alternatively, the rotational adaptor (303) can be rotated and locked into an shortened position (318*b*)

where the coupled holster plate (308) is positioned above a midline (M). This shortened position (318*b*) allows the coupled holster (not shown) to be positioned approximately adjacent to the base (301) and higher on the body of a user which may accommodate a shortened or more proximal position from which to draw a firearm.

In the preferred embodiment shown in FIGS. 1-10, the rotation of the rotational adaptor (303) relative to the base (301) can be restricted. Specifically, in this embodiment the rotational adaptor (303) of the invention can rotate around the caster pivot (305) along the traverse distance of a caster channel (306) on the rotational adaptor (303). So, for example as the rotational adaptor (303) rotates forward, the caster channel (306) rotates along pathway A until it contacts a fastener, or other similar pin or coupler positioned through the channel (306) and secured to the base (301) that mechanically restricts further rotational movement along pathway A. In this configuration, the length or traverse of the channel can determine the limits of forward or reverse rotational movement, or caster of the rotational adaptor (303) relative to the base (301).

The rotational holster hanger (300) of the invention can be configured to allow the cambered angle along pathway D of a coupled holster (not shown) relative to a base (301). In this embodiment, a rotational adaptor (303) is configured to be responsive to a holster plate (308) through a camber joint (309) allowing the cambered movement of the holster plate (308) along pathway D relative to the base (101).

As shown in FIGS. 18-23, the rotational adaptor (303) of the invention can be responsive to a holster (not shown) through a camber joint (309) configured to adjust the camber angle of a holster plate (308) along pathway D. In the preferred embodiment shown in FIG. 20, the rotational adaptor (303) of the invention can be coupled with a holster plate (308) through a camber joint (309) configured to allow the cambered swinging movement of the holster plate (308) along pathway D. In this preferred embodiment, the camber joint (309) of the invention includes a camber pivot (312) secured by, for example, a fastener or similar pin component positioned within a camber pivot aperture (314) on the body of the rotational adaptor (303). In this configuration, the holster plate (308) can rotate along the camber pivot (312) thereby allowing the cambered swinging movement of the holster plate (308) along pathway D as shown in the Figures.

Again referring to the embodiment shown in FIG. 20, the camber joint (309) of the invention can further include a camber channel (311) positioned on a camber arm (310) that can be positioned adjacent to a camber aperture (313) on the rotational adaptor (303). In this configuration, a fastener or pin can be inserted through the camber channel (311) and secured within a camber aperture (313). In this embodiment the holster plate (308) of the invention can rotate around the camber pivot (312) along the traverse distance of the camber channel (311), such that as the holster plate (308) rotates outward or inward along pathway D while the camber channel (311) moves along pathway D until a fastener, or other similar pin or coupler positioned through the camber channel (311) mechanically restricts further movement along pathway D. In this configuration, the length or traverse of the camber channel (311) can determine the limits of cambered movement of the holster plate (308).

Notably, while the rotational adaptor (303), and holster plate (308) are shown as separate components, in certain embodiments they can form a single integral component.

Naturally, all embodiments discussed herein are merely illustrative and should not be construed to limit the scope of the inventive technology consistent with the broader inventive principles disclosed. As may be easily understood from the foregoing, the basic concepts of the present inventive technology may be embodied in a variety of ways. It generally involves systems, methods, techniques as well as devices directed to various embodiments related to an adjustable holster hanger and the like. In this application, the methods and apparatus for the aforementioned systems are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the statements of invention. As can be easily understood from the foregoing, the basic concepts of the present invention may be embodied in a variety of ways. It involves both techniques as well as devices to accomplish the appropriate system. In this application, the techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in method-oriented terminology, each element of the claims corresponds to a device. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting any claims. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "coupler" should be understood to encompass disclosure of the act of "coupling"—whether explicitly discussed or not—and, conversely, were there effectively disclosure of the act of "coupling", such a disclosure should be understood to encompass disclosure of a "coupling method and/or technique, and/or device." Such changes and alternative terms are to be understood to be explicitly included in the description.

Thus, the applicant(s) should be understood to have support to claim and make a statement of invention to at least: i) each of the methods and/or apparatus for providing an adjustable holster hanger as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in Hakim v. Cannon Avent Group, PLC, 479 F.3d 1313 (Fed. Cir 2007), or the like are expressly not intended in this or any subsequent related matter. In addition, support should be understood to exist to the degree required under new matter laws—including but not limited to European Patent Convention Article 123 (2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. It should be understood that this application also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon. The inventive subject matter is to include, but certainly not be limited as, a system substantially as herein described with reference to any one or more of the Figures and Description (including the following: for example, the process according to any claims and further comprising any of the steps as shown in any Figures, separately, in any combination or permutation).

What is claimed is:

1. A multi-directional adjustable holster hanger device comprising:

a base coupled with an arm through a caster joint allowing rotation of the arm relative to the base, comprising a first orientation;

a rail adaptor slidably coupled with said arm through a rail joint allowing said rail adaptor to be positioned along the length of said arm, comprising a second orientation;

a camber adaptor responsive to a holster plate through a camber joint allowing cambered movement of the holster plate relative to said base, comprising a third orientation;

a toe adaptor forming a toe joint responsive to said holster plate allowing adjustment of the toe angle of the holster plate relative to the base, comprising a fourth orientation; and wherein each of said orientations can be simultaneously and independently adjusted without affecting the other orientations;

wherein said toe joint comprises:

a toe pivot coupled with a toe pivot aperture on said camber adaptor;

a toe channel on said toe adaptor; and wherein said toe adaptor is secured to said camber adaptor by a toe fastener secured to a toe aperture accessible through said toe channel, and wherein said camber adaptor rotates around said toe pivot allowing adjustment of the toe angle of the holster plate relative to the base.

2. The device of claim 1, wherein said caster joint comprises:

a caster pivot and a caster channel on said arm;

a caster aperture on said base; and wherein said arm is secured to said base through a fastener secured to the caster aperture accessible through said caster channel, and wherein said arm rotates around said caster pivot.

3. The device of claim 1, wherein said rail adaptor comprises a rail interface slidably engaged with a rail on said arm.

4. The device of claim 1, wherein said arm comprises a mounting surface.

5. The device of claim 1, wherein said camber joint comprises a camber arm on said holster plate having:

a camber channel secured by a fastener with a camber aperture on said camber adaptor; and a camber pivot secured by a fastener positioned within a camber pivot aperture on said camber adaptor;

wherein the fastened holster plate traverses along the camber channel generating the cambered movement of the holster plate relative to said base.

6. The device of claim 1, wherein said toe channel comprises a pair of toe channels.

7. The device of claim 6, wherein said toe adaptor is reversibly secured to said camber adaptor by the toe fastener secured to a toe aperture accessible through one of said pair of toe channels.

8. A multi-directional adjustable holster hanger device comprising:

a base coupled with an arm through a caster joint allowing rotation of the arm relative to the base, comprising a first orientation;

a rail adaptor slidably coupled with said arm through a rail joint allowing said rail adaptor to be positioned along the length of said arm, comprising a second orientation;

a camber adaptor responsive to a holster plate through a camber joint allowing cambered movement of the holster plate relative to said base, comprising a third orientation; and a toe adaptor forming a toe joint responsive to said holster plate allowing adjustment of the toe angle of the holster plate relative to the base, comprising a fourth orientation;

wherein said toe joint comprises:

a toe pivot coupled with a toe pivot aperture on said camber adaptor;

a toe channel on said toe adaptor; and wherein said toe adaptor is secured to said camber adaptor by a toe fastener secured to a toe aperture accessible through said toe channel, and wherein said camber adaptor rotates around said toe pivot allowing adjustment of the toe angle of the holster plate relative to the base.

9. The device of claim 8, wherein each of said orientations can be independently locked and unlocked without affecting the other orientations.

10. The device of claim 9, wherein said caster joint comprises:

a caster pivot and a caster channel on said arm;

a caster aperture on said base; and wherein said arm is secured to said base through a fastener secured to the caster aperture accessible through said caster channel, and wherein said arm rotates around said caster pivot.

11. The device of claim 8, wherein said rail adaptor comprises a rail interface slidably engaged with a rail on said arm.

12. The device of claim 8, wherein said arm comprises a mounting surface.

13. The device of claim 8, wherein said camber joint comprises a camber arm on said holster plate having:

a camber channel secured by a fastener with a camber aperture on said camber adaptor; and a camber pivot secured by a fastener positioned within a camber pivot aperture on said camber adaptor;

wherein the fastened holster plate traverses along the camber channel generating the cambered movement of the holster plate relative to said base.

14. The device of claim 8, wherein said toe channel comprises a pair of toe channels.

15. The device of claim 14, wherein said toe adaptor is reversibly secured to said camber adaptor by the toe fastener secured to a toe aperture accessible through one of said pair of toe channels.

* * * * *